US007250000B2

(12) United States Patent
Daniels, II

(10) Patent No.: US 7,250,000 B2
(45) Date of Patent: Jul. 31, 2007

(54) BUILDING WITH IMPROVED VENT ARRANGEMENT

(76) Inventor: William B. Daniels, II, 7535 Healdsburg Ave., Sebastopol, CA (US) 95472

( * ) Notice: Subject to any disclaimer, the term of this patent is extended or adjusted under 35 U.S.C. 154(b) by 0 days.

(21) Appl. No.: 11/212,204

(22) Filed: Aug. 24, 2005

(65) Prior Publication Data

US 2006/0052047 A1 Mar. 9, 2006

Related U.S. Application Data

(60) Provisional application No. 60/639,145, filed on Dec. 22, 2004, provisional application No. 60/619,708, filed on Oct. 15, 2004, provisional application No. 60/607,354, filed on Sep. 2, 2004.

(51) Int. Cl.
*F24F 13/02* (2006.01)
*F24F 3/00* (2006.01)

(52) U.S. Cl. ..... 454/250; 454/237

(58) Field of Classification Search ..... 454/237, 454/250, 241, 246, 247, 248
See application file for complete search history.

(56) References Cited

U.S. PATENT DOCUMENTS 1,324,059 A * 12/1919 Mead ..... 454/237
1,468,812 A * 9/1923 Holmes ..... 52/28
1,562,865 A * 11/1925 Brown ..... 454/289
1,764,343 A 6/1930 Petrelli
2,131,725 A * 10/1938 Chester ..... 454/269
2,262,243 A * 11/1941 Lord ..... 454/228
2,341,113 A 2/1944 Nelson
2,789,493 A 4/1957 Riggle
2,961,940 A * 11/1960 Kump ..... 454/228
3,303,770 A * 2/1967 Anthony ..... 454/186
3,457,848 A * 7/1969 Pankow ..... 454/185
3,802,327 A 4/1974 Otsuka
4,201,121 A 5/1980 Brandenberg, Jr.
4,523,519 A * 6/1985 Johnson ..... 454/185
4,944,216 A * 7/1990 McCutchen ..... 454/342

(Continued)

FOREIGN PATENT DOCUMENTS

GB 2 386 944 A 10/2001

(Continued)

*Primary Examiner*—Gregory Wilson
(74) *Attorney, Agent, or Firm*—Knobbe Martens Olson & Bear LLP

(57) ABSTRACT

A system and method of vent placement within a building is provided for improved passive ventilation. Vents are provided within the dividing structures or material layers that form the building's exterior and interior walls, ceiling, roof, floor, and/or intermediate story-defining "ceiling-floors." Preferably, each vent is not a conventional ventilation stack and is oriented generally along a planar portion of the dividing structure within which the vent is positioned. Preferably, each vent is substantially entirely contained within its associated dividing structure. Vents are provided in corner sections of exterior walls, roof-portions, and the bottom floor of the building. Vents are also provided in corner sections of the ceiling portions, floor portions, and wall portions that define the interior rooms of the building. The vents are preferably vertically aligned throughout a substantial portion of the height (or more preferably substantially the entire height) of the building, at one or more horizontal positions thereof, to thereby produce one or more substantially vertical flows of air upward and out of the building, without the use of stack vents.

52 Claims, 17 Drawing Sheets

U.S. PATENT DOCUMENTS

| | | | | |
|---|---|---|---|---|
| 5,402,611 | A * | 4/1995 | Vagedes | 52/198 |
| 5,447,470 | A | 9/1995 | Zaniewski | |
| 5,934,993 | A | 8/1999 | Maruyama | |
| 6,077,159 | A | 6/2000 | Clayton | |
| 6,319,115 | B1 * | 11/2001 | Shingaki | 454/186 |
| 6,341,468 | B1 * | 1/2002 | Bigelow | 52/745.13 |
| 6,428,680 | B1 * | 8/2002 | Kreichauf | 205/628 |
| 6,832,951 | B2 * | 12/2004 | Orendorff | 454/290 |
| 7,024,829 | B2 * | 4/2006 | Sharp et al. | 52/199 |

FOREIGN PATENT DOCUMENTS

| | | | |
|---|---|---|---|
| JP | 57070338 | | 4/1982 |
| JP | 10110480 | A | 4/1998 |
| JP | 11029992 | A | 2/1999 |
| JP | 2001221474 | A | 8/2001 |
| JP | 2002121833 | | 4/2002 |
| JP | 2003 082782 | | 3/2003 |
| JP | 2003185207 | | 7/2003 |
| WO | WO 86/07438 | | 12/1986 |

* cited by examiner

BUILDING WITH IMPROVED VENT ARRANGEMENT

CLAIM FOR PRIORITY

This application claims the priority benefit under 35 U.S.C. § 119(e) of Provisional Application Ser. Nos. 60/607,354, filed Sep. 2, 2004; 60/619,708, filed Oct. 15, 2004; and 60/639,145, filed Dec. 22, 2004. The full disclosures of these priority applications are incorporated herein by reference.

BACKGROUND OF THE INVENTION

1. Field of the Invention

The present invention relates generally to building ventilation and more specifically to passive ventilation of buildings.

2. Description of the Related Art

Many buildings are ventilated with so-called "active ventilation" or "mechanical ventilation" apparatus, which typically involves the use of mechanical devices such as fans, air conditioners, etc., which create a forced flow of air through various ducts and vents of the building. In many cases, it is desirable to avoid active ventilation in order to reduce energy requirements.

So-called "passive ventilation" involves an arrangement of vents within a building, without mechanical devices that create a forced flow of air. For example, roof-vents are often placed within the roof of a house to permit airflow between the attic and the house exterior. FIG. 1 shows a house 1 including exterior walls 2, a floor 3, a ceiling 4, and a roof 5 such that an attic space 7 is defined between the ceiling and the roof. The roof includes roof-vents 6, which allow for ventilation of the attic space 7. While this permits ventilation of the attic, the remainder of the house is usually not passively ventilated because the attic is closed off from the rest of the house.

In some cases, passive ventilation has been used outside of the context of only the attic. Some buildings, particularly European homes, employ "passive stack ventilation," in which the house includes "stack vents" (i.e., pipes or ducts) with lower ends terminating in rooms likely to have higher pollutant levels, such as kitchens, bathrooms, and laundry rooms, and upper ends extending vertically through the roof. These stack vents are also sometimes referred to as "soil vents."

In a typical design employing passive stack ventilation, a room of a building is provided with wall-vents near the lower edges of the vertical walls that define the room, the wall-vents communicating with the exterior of the building. The room also includes an open lower end of a stack vent. The stack vent typically extends upward through the ceiling of the room and eventually through the roof of the building, terminating at an upper open end. The stack vent typically also extends upward through other rooms and/or an attic of the building. Similarly, other rooms may be ventilated with additional wall-vents and stack vents. Air ventilation through the passive stack ventilation system is primarily caused by pressure differences derived from (1) wind flow passing over the building and the upper end of the stack vent, which causes a venturi effect in the stack vents, and (2) buoyancy differences between indoor and outdoor air. If, as is often the case, indoor air temperatures are higher than outdoor temperatures, the warmer and less dense indoor air tends naturally to rise up through the ventilating stack vents. As the indoor air rises, it draws in cooler outdoor air through the wall-vents.

Traditional rural huts in countries such as Thailand use thatched bamboo walls and thatched roofs through which air can flow. Such huts are often raised above the ground with the floors also having openings through which air may flow.

In some buildings, the bottom floor is raised above the ground so that there is an enclosed airspace below the bottom floor. Some such buildings include floor-vents in the floor and other vents to provide for airflow between the building exterior and the airspace below the bottom floor. One design involves a pipe with one end outside the building and another end opening to the airspace below the bottom floor of the building, the pipe extending underground. Another design involves wall-vents in vertical walls extending below the bottom floor.

SUMMARY OF THE INVENTION

Conventional systems for passive ventilation of buildings are limited in their ability to adequately ventilate a building. For example, while passive stack ventilation provides some passive ventilation of a building, it has been restricted to kitchens, bathrooms, and/or laundry rooms. While the stack vents may extend through other (non-pollutant) rooms of the building, they do not permit venting of said rooms because the stack vents are not open to such rooms. Also, passive stack ventilation is somewhat restricted because it involves the flow of air through elongated stack vents, which sometimes include turns and irregular configurations. Adequate ventilation through the stack vents is often dependent upon suction at the upper ends of the stack vents, due to a venturi effect caused by winds above the building. The stack vents inhibit the building from "breathing" freely. Thus, buildings having stack vents, perhaps in combination with vents in the floor or exterior walls, provide less than optimal ventilation.

As used herein, a "dividing-structure vent" (referred to as a "non-stack vent" in some of the priority applications) is a vent that is formed in a roof, ceiling, floor, wall, or the like and which is not a stack vent. In other words, a dividing-structure vent defines an opening in a dividing structure or material layer, which opening does not involve an elongated pipe or other structure extending generally through the dividing structure. Skilled artisans will appreciate that there are a wide variety of different types of dividing-structure vents. A dividing-structure vent may include materials for visually blending the vent with the dividing structure so that it is inconspicuous. A dividing-structure vent may also include screens, filters, and other such components for preventing the flow of matter other than air (e.g., water, vermin, insects, dust, plants, leaves, etc.) through the vent. Dividing-structure vents are less restrictive and facilitate less restrictive ventilation because the air does not have to flow through stack vents, i.e., relatively narrow elongated structures. Also, a dividing-structure vent permits airflow between the general airspace on two sides of a dividing structure, while a stack vent only communicates with the space inside the stack vent. Typically, a dividing-structure vent is oriented generally along a planar portion defined by the dividing structure. Also, a dividing-structure vent oriented generally along the planar portion may either be substantially entirely contained within the dividing structure or may protrude to some degree outside of the dividing structure. A dividing-structure vent may comprise a wall vent, roof vent, ceiling vent, ceiling-floor vent, or under-floor-vent, as these terms are used and described herein.

Some known passive ventilation systems include dividing-structure vents in the exterior walls and roof of a building. Some known systems include dividing-structure vents in the exterior walls, the roof, and the horizontal divisions that define the separate stories of a multistory building. While these systems provide some degree of passive ventilation for the building, it is often insufficient to obviate the need for mechanical ventilation. There is a need for a more comprehensive passive ventilation system involving dividing-structure vents, to permit the building to "breathe" freely, particularly for multiple-story buildings.

The aforementioned traditional rural huts in countries such as Thailand provide very good ventilation because air can flow relatively freely through the thatched walls and roof and the slots in the elevated floor. However, such a design is generally not desirable for use in industrialized countries for a variety of reasons. One such reason is that such a design does not involve air-impervious walls, floors, ceilings, and roofs, making it very expensive to heat up the building in colder weather and cool down the building in warmer weather.

Accordingly, it is a principle advantage of the present invention to overcome some or all of these limitations and to provide an improved design for the arrangement of vents within a building.

In one aspect, the present invention provides a building comprising a substantially air-impervious bottom floor, a generally vertical exterior wall structure, one or more generally vertical interior walls within the exterior wall structure, and a roof. The exterior wall structure surrounds at least a portion of the bottom floor and defines an outer periphery of the building. The exterior wall structure is substantially air-impervious except for the presence of a plurality of wall-vents therein, the wall-vents permitting airflow through the exterior wall structure. The one or more interior walls define a plurality of rooms of the building, each of the one or more interior walls acting as a division between two of the rooms. The one or more interior walls are substantially air-impervious except for the presence of one or more wall-vents in the one or more interior walls. Each of the one or more wall-vents permits airflow through one of the one or more interior walls. The roof is positioned above the bottom floor, the exterior wall structure, and the one or more interior walls. The roof is substantially air-impervious except for the presence of one or more roof-vents therein. Each of the one or more roof-vents is oriented generally along a planar portion of the roof and permits airflow between an airspace immediately underneath the roof and within the building and an airspace immediately above the roof.

In another aspect, the present invention provides a building comprising a bottom floor, a generally vertical exterior wall structure, a roof, and a ceiling. The bottom floor is substantially air-impervious except for the presence of one or more floor-vents therein. Each of the one or more floor-vents permits airflow between an airspace immediately above the bottom floor and an airspace immediately below the bottom floor. The exterior wall structure surrounds at least a portion of the bottom floor and defines an outer periphery of the building. The exterior wall structure is substantially air-impervious except for the presence of a plurality of wall-vents therein, the wall-vents permitting airflow through the exterior wall structure. The roof is positioned above the bottom floor and the exterior wall structure and is substantially air-impervious except for the presence of one or more roof-vents therein. Each of the one or more roof-vents is oriented generally along a planar portion of the roof and permits airflow between an airspace immediately underneath the roof and within the building and an airspace immediately above the roof. The ceiling is positioned below the roof so that the ceiling and the roof define an attic space therebetween. The ceiling is substantially air-impervious except for the presence of one or more ceiling-vents therein. Each of the one or more ceiling-vents is oriented generally along a planar portion of the ceiling and permits airflow between the attic airspace and an airspace immediately below the ceiling.

In another aspect, the present invention provides a multiple story building comprising a substantially air-impervious bottom floor, a generally vertical exterior wall structure, one or more generally vertical interior walls within the exterior wall structure, one or more generally horizontal structures elevated above the bottom floor and dividing the building into multiple stories, and a roof. The exterior wall structure surrounds at least a portion of the bottom floor and defines an outer periphery of the building. The exterior wall structure is substantially air-impervious except for the presence of a plurality of wall-vents therein, the wall-vents permitting airflow through the exterior wall structure. The one or more generally vertical interior walls define a plurality of rooms of the building. Each of the one or more interior walls acts as a division between two of the rooms. The one or more interior walls are substantially air-impervious except for the presence of one or more wall-vents therein. Each of the one or more wall-vents permits airflow through one of the one or more interior walls. Each of the one or more horizontal structures defines a floor of at least one room immediately above the horizontal structure and a ceiling of at least one room immediately below the horizontal structure. Each of the one or more horizontal structures is substantially air-impervious except for the presence of at least one ceiling-floor vent therein. The at least one ceiling-floor vent of each horizontal structure is oriented generally along a planar portion of the horizontal structure and permits generally vertical airflow through the horizontal structure. The roof is positioned above the bottom floor, the exterior wall structure, the one or more interior walls, and the one or more horizontal structures.

In yet another aspect, the present invention provides a building comprising a generally vertical exterior wall structure defining an outer periphery of the building, and a room within the exterior wall structure. The exterior wall structure is substantially air-impervious except for the presence of a plurality of wall-vents in the exterior wall structure, the wall-vents permitting airflow through the exterior wall structure. The room is defined by a plurality of dividing structures that are substantially air-impervious. Each of the dividing structures has a plurality of corner sections. Dividing-structure vents are provided in at least half of the corner sections of one of the dividing structures. Each of the dividing-structure vents permits airflow through its dividing structure.

In yet another aspect, the present invention provides a building comprising a bottom floor, a generally vertical exterior wall structure surrounding at least a portion of the bottom floor and defining an outer periphery of the building, and a roof positioned above the bottom floor and the exterior wall structure. The exterior wall structure is substantially air-impervious except for the presence of a plurality of wall-vents therein, the wall-vents permitting airflow through the exterior wall structure. The roof comprises one or more generally flat roof-portions joined together. Each of the roof-portions has a plurality of corner sections and is substantially air-impervious except for the presence of roof-vents that are oriented generally along a planar portion of that roof-portion and are positioned in at least half of the corner sections of that roof-portion. Each of the roof-vents permits airflow generally vertically through the roof.

In yet another aspect, the present invention provides a building comprising a bottom floor, a plurality of generally vertical exterior walls, and a roof positioned above the bottom floor and exterior walls. The exterior walls are joined together to surround at least a portion of the bottom floor and define an outer periphery of the building. Each of the exterior walls has a plurality of corner sections and is substantially air-impervious except for the presence of wall-vents in at least half of the corner sections of that exterior wall. Each wall-vent permits airflow through the exterior wall within which that wall-vent is located.

In yet another aspect, the present invention provides a building comprising an exterior wall structure defining a periphery of the building, a bottom floor within the exterior wall structure, a roof above the exterior wall structure, and one or more horizontal dividing structures within the exterior wall structure. The roof includes a plurality of roof-vents. Dividing-structure vents are provided in each of the one or more horizontal dividing structures. Some of the dividing-structure vents are substantially vertically aligned with some of the roof-vents to facilitate substantially vertical airflow through the aligned vents.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

Some of the figures may include elements that are not drawn to scale with respect to one another.

DETAILED DESCRIPTION OF THE PREFERRED EMBODIMENTS

Figure 1:
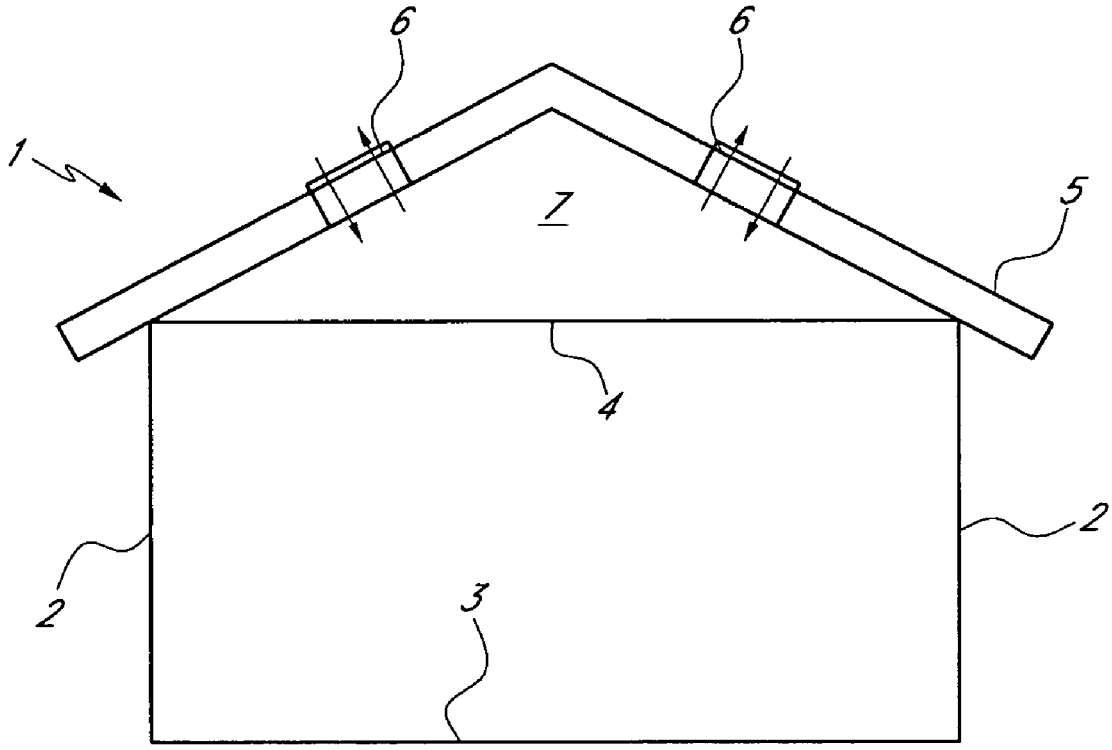
FIG. 1 (PRIOR ART)
FIG. 1 is a front sectional view of a conventional building with vents in the roof.
Figure 2:
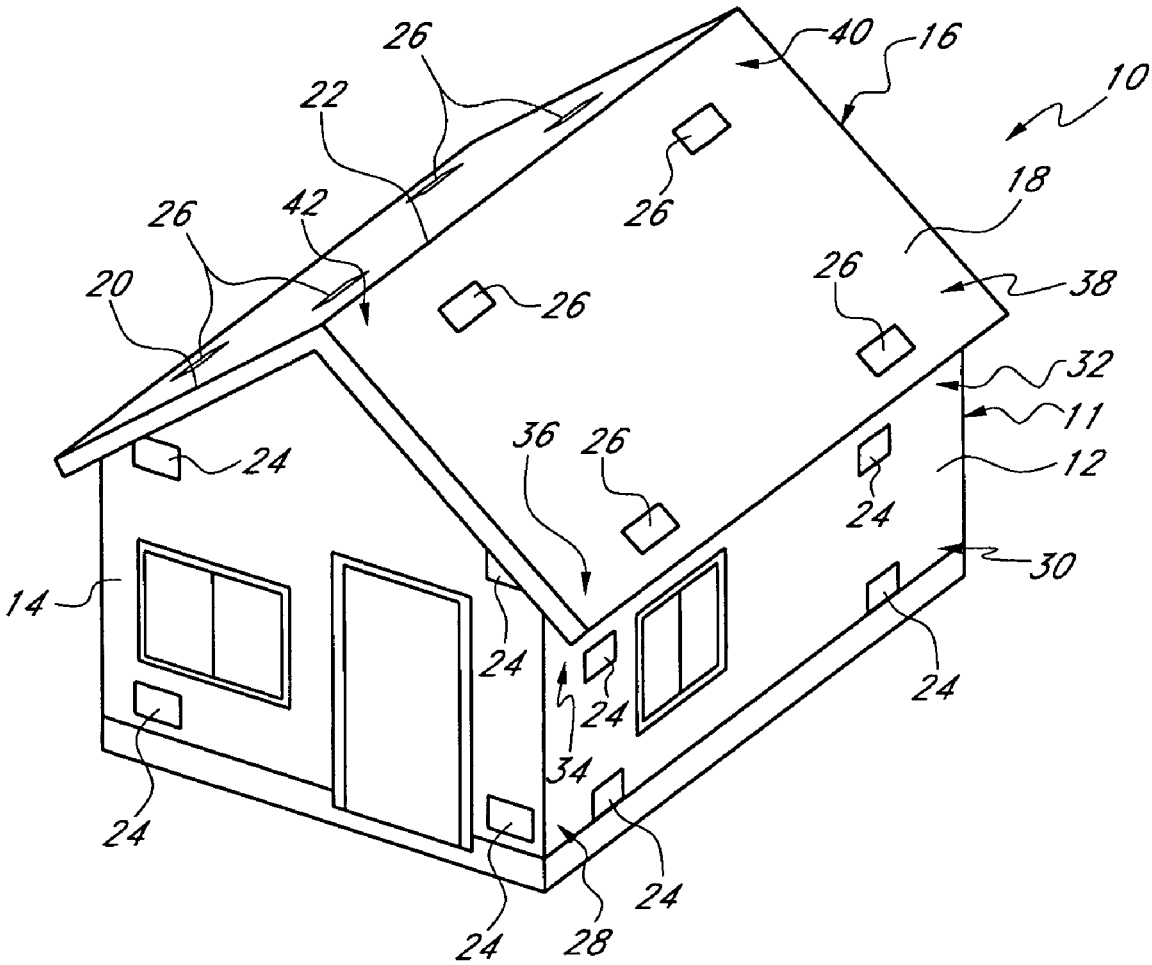
FIG. 2 is a perspective view of a building with a system of vents according to one embodiment of the present invention.

FIG. 2 shows a building 10, such as a home, having a system of vents according to one embodiment of the present invention. While the illustrated building 10 is single-story, it will be understood from the description below that the principles of the present invention can be used in multiple-story buildings as well. The building 10 includes a generally vertical exterior wall structure 11 defining an outer periphery of the building. In the illustrated embodiment, the exterior wall structure 11 comprises a plurality of generally vertical walls joined together, including exterior walls 12 and 14. While not shown in FIG. 2, the building 10 includes additional exterior walls behind the walls 12 and 14, such that the exterior walls collectively form the building periphery. Preferably, the plurality of exterior walls are joined together to form a closed perimeter, which defines the interior area of the building. In other embodiments, the exterior wall structure 11 may comprise a single wall that is curved to form an enclosed perimeter (e.g., a circular or oval structure). The building 10 also includes a roof 16. In the illustrated embodiment, the roof 16 includes two generally flat and sloped sides or roof-portions 18 and 20 that are joined together at a top ridge 22. However, other roof configurations are also possible, such as a generally flat horizontal roof. The roof 16 can be formed of a variety of materials, including metal (e.g., corrugated metal). While not shown in FIG. 2, the building 10 also includes a bottom floor that is at least partially surrounded by the exterior wall structure 11.

Preferably, the exterior wall structure 11 is substantially air-impervious with the exception of a plurality of wall-vents 24 in the exterior walls of the building. As used herein, the phrase "substantially air-impervious" describes a material or structure through which air substantially cannot pass, but does not exclude the presence of openings that can be opened and closed, such as doors and windows. Each wall-vent 24 permits airflow through the exterior wall within which that particular wall-vent is located, so that air can flow relatively freely through the vent 24 between the airspace immediately outward of the wall and the airspace immediately inward of the wall (wherein "inward" refers to the region within the building and "outward" refers to the region outside of the building). Each wall-vent 24 is preferably configured to permit airflow both inward and outward.

In the illustrated embodiment, each of the exterior walls of the building 10 has a plurality of "corner sections." As used herein, a corner section of a dividing structure or material layer (e.g., a wall, roof, floor, or the like) refers to a section where two edges of the dividing structure meet. For example, the exterior wall 12 includes bottom corner sections 28 and 30 and top corner sections 32 and 34. While the illustrated exterior wall 12 includes four corners and corner sections, it will be understood that walls can have a wide variety of different shapes with three, four, or more corners and corner sections. As used herein, a vent in a "corner section" includes vents that are near the corner defined by the dividing structures but not necessarily exactly at the corner. By herein stating that a vent is in a corner section associated with a corner of a room, floor, roof, ceiling-floor, interior wall, exterior wall, or other dividing structure (as such terms are described elsewhere herein), it is meant that the nearest portion of the vent is preferably within 36 inches, more preferably within 12 inches, and even more preferably within 6 inches of said corner. Preferably, wall-vents 24 are provided in one or more of the corner sections of each exterior wall. More preferably, wall-vents 24 are provided in at least half of the corner sections of each exterior wall. Even more preferably, wall-vents 24 are provided in all of the corner sections of each exterior wall. Advantageously, placing wall-vents 24 at the corner sections of the exterior walls facilitates better passive ventilation.

Preferably, the roof 16 is substantially air-impervious with the exception of one or more roof-vents 26 therein. Each roof-vent 26 permits airflow through the roof 16, so that air can flow relatively freely and generally vertically through the vent 26, between the general airspace immediately below the roof and within the building 10 and the general airspace immediately above the roof. The roof-vents 26 are preferably dividing-structure vents. Each roof-vent 26 is preferably configured to permit airflow both upward out of the building 10 and downward into the building.

In the illustrated embodiment, each of the sides or roof-portions 18 and 20 of the roof 16 has a plurality of corner sections. For example, the roof-portion 18 of the roof 16 includes bottom corner sections 36 and 38 and top corner sections 40 and 42. While the illustrated roof-portion 18 of the roof 16 includes four corner sections, it will be understood that roofs and/or roof-portions can have a wide variety of different shapes with three, four, or more corner sections. Preferably, roof-vents 26 are provided in one or more of the corner sections of each roof or roof-portion. By herein stating that a vent is in a corner section associated with a corner of a roof, it is meant that the nearest portion of the vent is preferably within 36 inches, more preferably within 12 inches, and even more preferably within 6 inches of the corner of the interior structure that the roof overlies, as opposed to the corner of an overhanging roof. More preferably, roof-vents 26 are provided in at least half of the corner sections of each roof or roof-portion. Even more preferably, roof-vents 26 are provided in all of the corner sections of each roof or roof-portion. Advantageously, placing roof-vents 26 at the corner sections of the roofs or roof-portions facilitates better passive ventilation. It is also desirable to locate the roof-vents 26 at or near to the highest location of the building interior, since it is such areas to which hot air rises.

Figure 4:
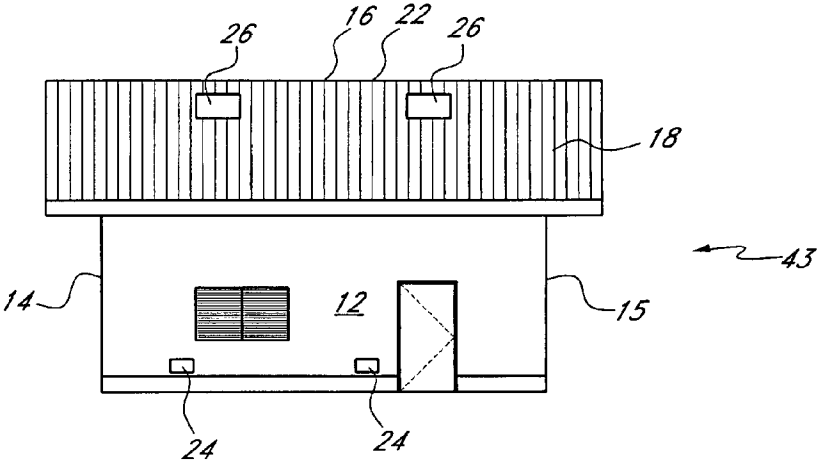
FIG. 4 is a side view of the building of FIG. 3.
Figure 3:
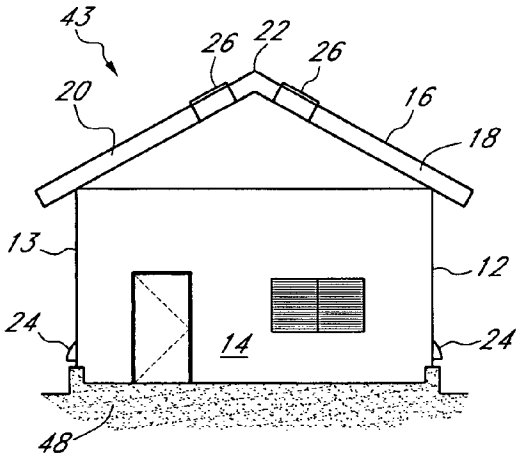
FIG. 3 is a front view of a building of the type shown in FIG. 2.
Figure 5:
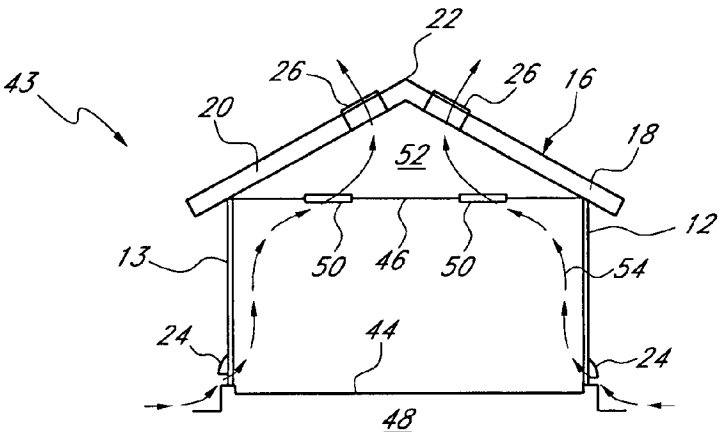
FIG. 5 is a front sectional view of the building of FIG. 3.

FIGS. 3-5 show a single-story building 43 that is similar to the building 10 shown in FIG. 2, wherein the same numerals refer to like aspects of the buildings. FIGS. 3 and 4 show front and side views, respectively, of the building 43. FIG. 5 shows a front sectional view of the building 43. The building 43 is formed on a foundation 48 as known in the art. Unlike the building 10 of FIG. 2, the exterior walls 12, 13, 14, and 15 of the building 43 only include wall-vents 24 near their bottom edges and not near their top edges. However, additional wall-vents 24 could be provided near the top edges of the exterior walls if desired. Also unlike the building 10 of FIG. 2, the roof-portions 18 and 20 of the roof 16 only include roof-vents 26 near the ridge 22 and not near their bottom edges. However, additional roof-vents 26 could be provided near the bottom edges of the roof-portions 18 and 20 of the roof 16 if desired.

As seen in FIG. 5, the building 43 includes a generally horizontal bottom floor 44 and a ceiling 46. In the illustrated embodiment, the ceiling 46 is generally horizontal and is positioned below the roof 16 so that the ceiling 46 and the roof 16 define an attic airspace 52 therebetween. Skilled artisans will understand that, in some embodiments, there is only a ceiling or only a roof, but not both. Preferably, the ceiling 46 is substantially air-impervious except for the presence of one or more ceiling-vents 50 therein. Each ceiling-vent 50 is preferably a dividing-structure vent that permits airflow between the general attic airspace 52 and a general airspace immediately below the ceiling 46. Each ceiling-vent 50 is preferably configured to permit airflow both upward into the attic space 52 and downward below the ceiling 46.

With continued reference to FIG. 5, the building 43 facilitates a relatively less restricted flow of air upward (depicted by arrows 54), compared to conventional passive ventilation designs and particularly passive stack ventilation systems. The indoor air tends to flow upward due to pressure differences derived from (1) wind flow passing over the roof 16, which causes a venturi effect in the roof-vents 26, and (2) buoyancy differences between indoor and outdoor air. The indoor air rises upward relatively freely (compared to passive stack ventilation systems) through the interior of the building and flows through the ceiling-vents 50 of the ceiling 46 into the attic space 52. From the attic space 52, the indoor air continues to rise relatively freely through the roof-vents 26 of the roof 16 and exits the building. As the indoor air rises, it draws in cooler outdoor air through the wall-vents 24 near the bottom edges of the exterior walls 12, 13, 14, and 15.

Figure 7:
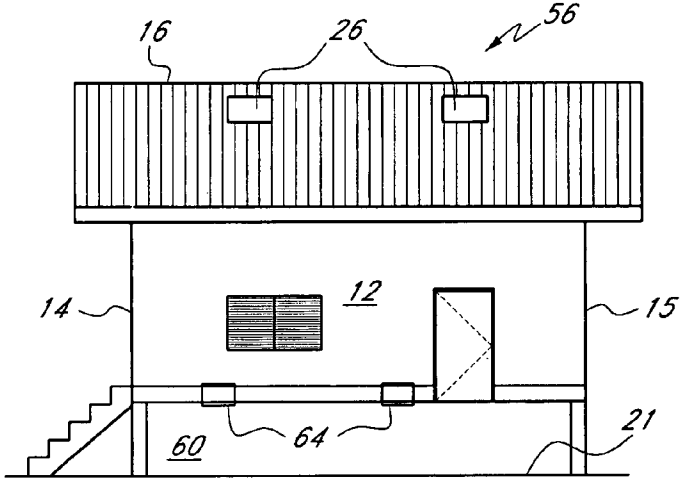
FIG. 7 is a side view of the building of FIG. 6.
Figure 6:
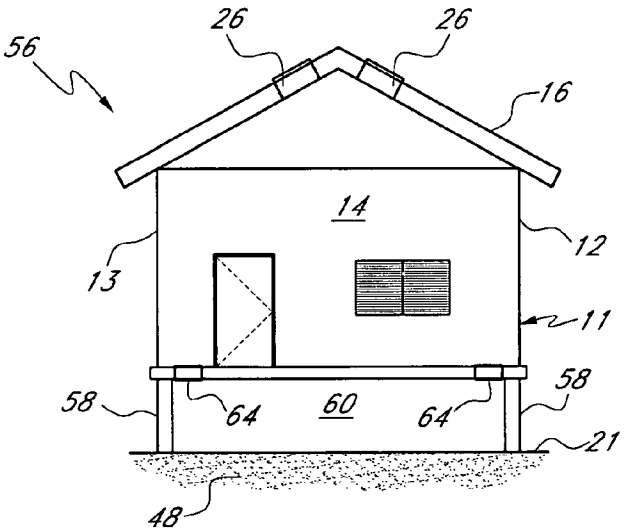
FIG. 6 is a front view of a building with a system of vents according to another embodiment of the present invention.
Figure 8:
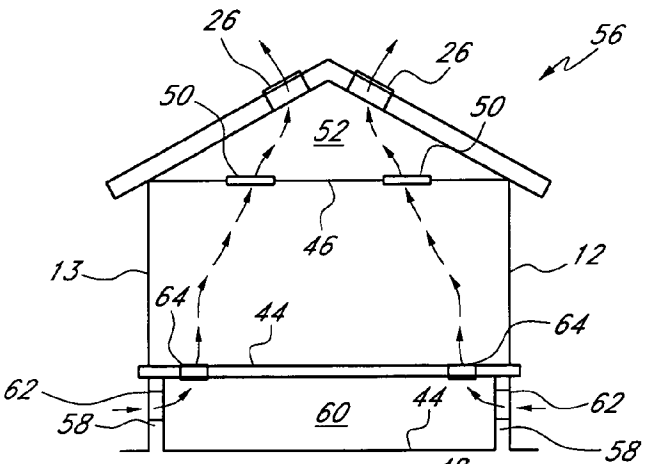
FIG. 8 is a front sectional view of the building of FIG. 6.

FIGS. 6-8 show a building 56 with a system of vents according to another embodiment of the present invention. FIGS. 6 and 7 show front and side views, respectively, of the building 56. FIG. 8 shows a front sectional view of the building 56. The building 56 is similar in most respects to the building 43 shown in FIGS. 3-5, except that the bottom floor 44 is raised above the foundation 48. In one embodiment, the bottom floor 44 and exterior wall structure 11 are elevated above a ground level 21 such that air outside of the outer periphery of the building 56 can freely flow underneath the bottom floor 44. For example, support structures 58 can be provided for supporting the exterior wall structure 11 and bottom floor 44. In one configuration, the support structures 58 comprise supports positioned at the corners and other discrete locations of the building 56, as may be necessary to adequately support the building. In another configuration, the support structures 58 comprise walls, which may extend along the building periphery. The support structures 58 can be materially different (such as concrete foundation) and structurally separate from the exterior wall structure 11. Alternatively, the support structures 58 can comprise walls that are materially similar and/or extensions or portions of the exterior wall structure 11 of the building 56, such as portions of the exterior walls 12, 13, 14, and 15. In the illustrated embodiment, the support structures 58 comprise walls that define a peripherally enclosed airspace 60 below the bottom floor 44, and the building 56 includes one or more "underfloor-vents" 62 configured to permit airflow between the exterior of the building and the enclosed airspace 60. As used herein, an "underfloor-vent" is a vent that facilitates the flow of air between the exterior of the building and an airspace below the bottom floor of the building. In the illustrated embodiment, the underfloor-vents 62 comprise wall-vents in the walls 58. However, other types of underfloor-vents can be used, such as pipes or ducts that may extend partially underground. The underfloor-vents 62 may extend laterally within the walls 58, perhaps as much as 80% of the sides of the building. The underfloor-vents 62 may comprise louvers covered with plastic or wire mesh on a wire back, such as chicken wire or even something stronger, in order to prevent the ingress of small animals, debris, plants, and the like. In one embodiment, the underfloor-vents 62 are about 10 inches in vertical height, such as a vent that is about 10×10 inches in area.

In the building 56, the elevated bottom floor 44 is preferably substantially air-impervious except for the presence of one or more floor-vents 64 therein. Each floor-vent 64 permits airflow through the bottom floor 44. More particularly, each of the floor-vents 64 is preferably a dividing-structure vent permitting airflow generally vertically through the bottom floor 44, between a general airspace immediately above the bottom floor and the airspace 60 immediately below the bottom floor. Thus, the underfloor-vents 62, floor-vents 64, ceiling-vents 46, and roof-vents 26 produce a generally upward ventilation of air through the building.

Figure 9:
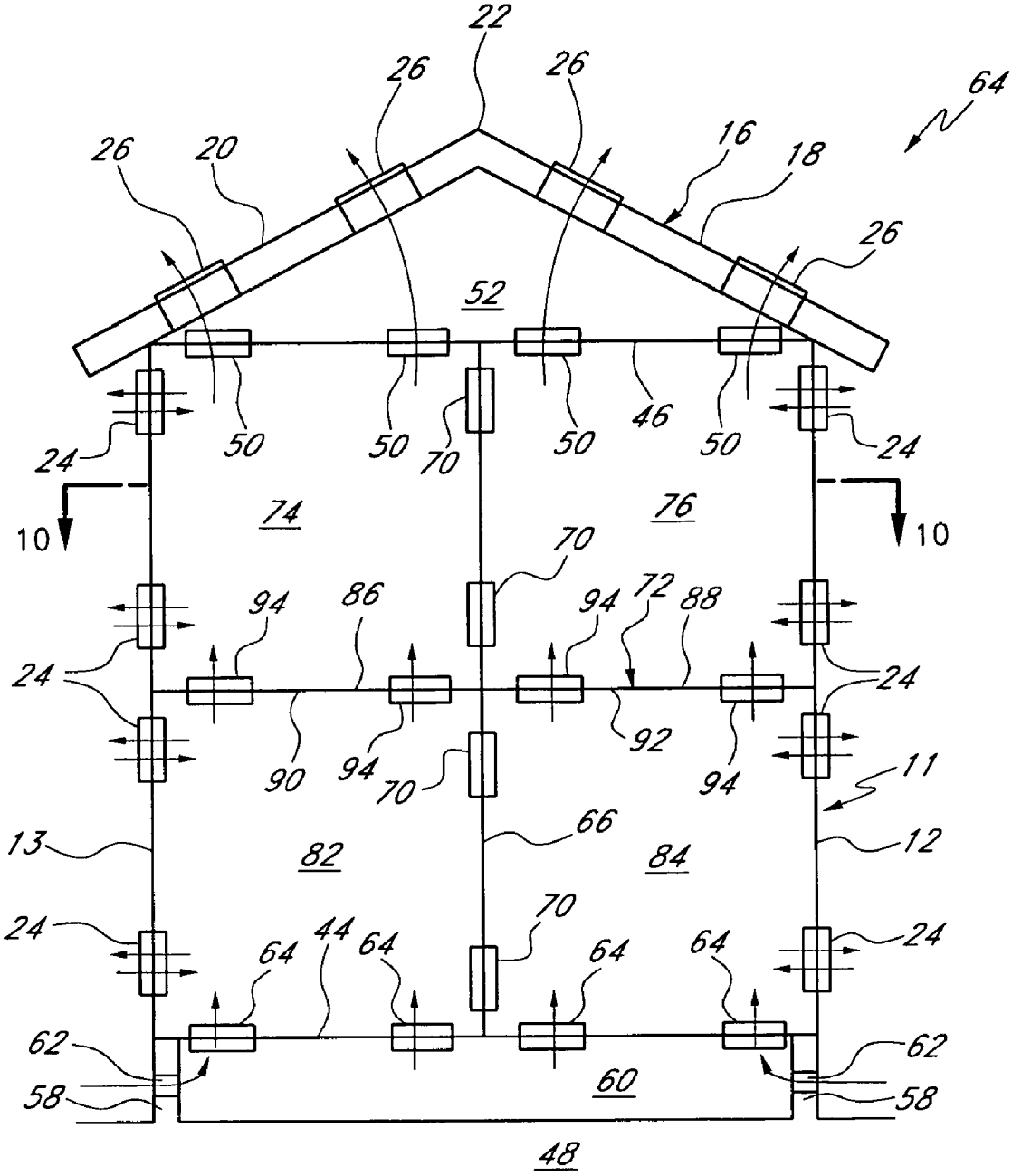
FIG. 9 is a front sectional view of a building with a system of vents according to another embodiment of the present invention, taken along line 9-9 of FIG. 10.
Figure 10:
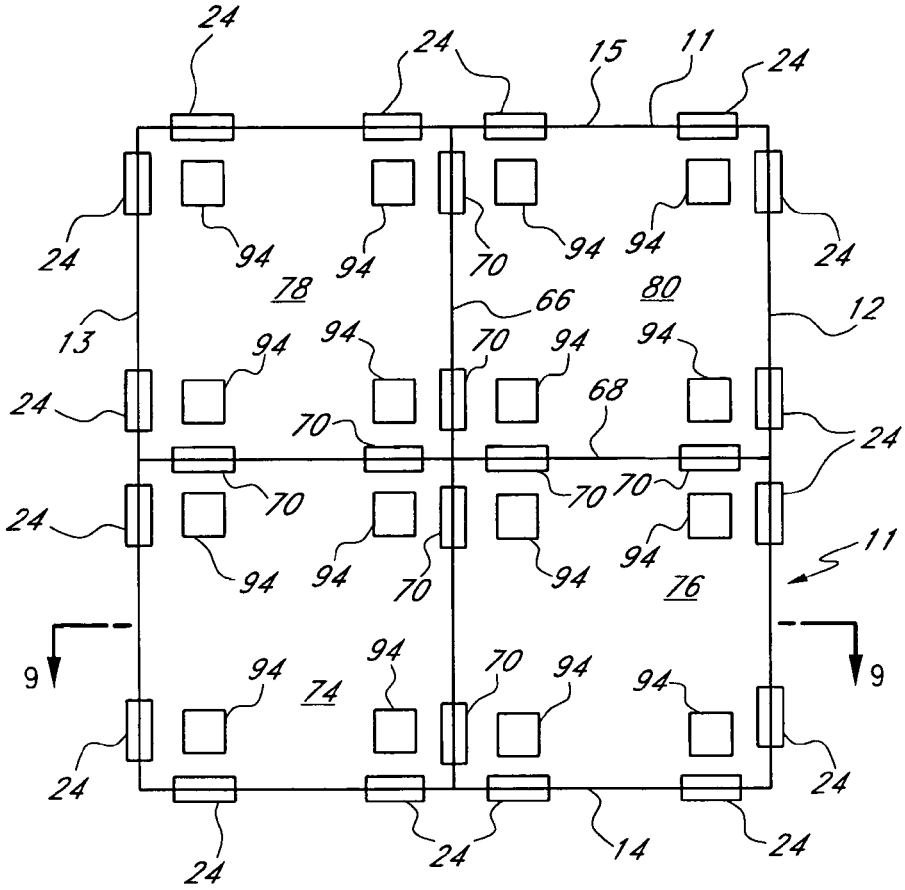
FIG. 10 is a top sectional view of the building of FIG. 9, taken along line 10-10 thereof.

FIGS. 9 and 10 illustrate the application of the invention in a building having multiple stories and multiple internal rooms. In particular, FIGS. 9 and 10 show a building 64 having two stories and four rooms per story, for a total eight rooms. Skilled artisans will understand that the invention can be employed in buildings having any number of stories and any number of rooms per story. Also, the rooms can vary in size and shape relative to one another, as is the case in a typical building. The building 64 includes an exterior wall structure 11 (comprising exterior walls 12, 13, 14, and 15), a bottom floor 44, a roof 16, and a ceiling 46, substantially as described in the aforementioned embodiments. Like the building 56 shown in FIGS. 6-8, the building 64 is raised above the top surface 21 of a foundation 48 by supports 58, which in the illustrated embodiment comprise walls with underfloor wall-vents 62 as described above. It will be understood that the building 64 could alternatively be set directly upon a foundation 48, in the manner shown in FIGS. 2-5.

With continued reference to FIGS. 9 and 10, the illustrated building 64 includes two interior walls 66 and 68 within the exterior wall structure 11. The interior walls 66 and 68 each extend vertically from the bottom floor 44 to the ceiling 46. In other embodiments, the interior walls may extend vertically within only one or more stories, without extending completely from the bottom floor 44 to the ceiling 46. The interior wall 66 extends horizontally from the exterior wall 14 to the exterior wall 15, and the interior wall 68 extends horizontally from the exterior wall 12 to the exterior wall 13. In other embodiments, the interior walls 66, 68 do not extend horizontally to the exterior walls of the building. The illustrated interior walls 66 and 68 intersect to define four interior rooms per story of the building. For example, the top story of the building 64 includes four interior rooms 74, 76, 78, and 80. Each of the interior walls 66 and 68 preferably acts as a division between two of the rooms. Preferably, each of the interior walls 66 and 68 is substantially air-impervious except for the presence of one or more wall-vents 70 therein. Each of the wall-vents 70 preferably permits airflow through the interior wall within which said wall-vent is located. Skilled artisans will understand that any number of interior walls (including just one interior wall) can be provided to result in different numbers of interior rooms, and that the principles of the present invention are applicable to such variations.

The building 64 can include one or more generally horizontal structures 72 elevated above the bottom floor 44 and dividing the building into multiple stories. The number of horizontal structures 72 defines the number of stories of the building 64. Typically, the number of stories is one greater than the number of horizontal structures 72. Of course, different and/or irregular configurations are possible, including mezzanine levels and the like. The illustrated building 64 includes only one horizontal structure 72 and is thus a two-story building. Each of the horizontal structures 72 preferably defines one or more floors of interior rooms immediately above the horizontal structure. For example, the illustrated horizontal structure 72 defines floors 86 and 88 of the interior rooms 74 and 76 immediately above the horizontal structure. In the illustrated embodiment, the floors 86 and 88, as well as the floors of the interior rooms 78 and 80, are defined by one horizontal structure 72 and may be understood as one unitary floor. Each of the horizontal structures 72 also preferably defines one or more ceilings of interior rooms immediately below the horizontal structure. For example, the illustrated horizontal structure 72 defines ceilings 90 and 92 of interior rooms 82 and 84 immediately below the horizontal structure. In the illustrated embodiment, the ceilings 90 and 92, as well as the ceilings of the interior rooms directly behind the rooms 82 and 84 in FIG. 9, are defined by one horizontal structure 72 and may be understood as one unitary ceiling. Preferably, each of the horizontal structures 72 is substantially air-impervious except for the presence of at least one "ceiling-floor vent" 94 therein. Each ceiling-floor vent 94 preferably permits air-flow generally vertically through the horizontal structure 72 of that vent 94, between the general airspace immediately above and below the horizontal structure 72. In one embodiment, the ceiling-floor vents 94 are substantially identical to the ceiling-vents 50.

Figure 27B:
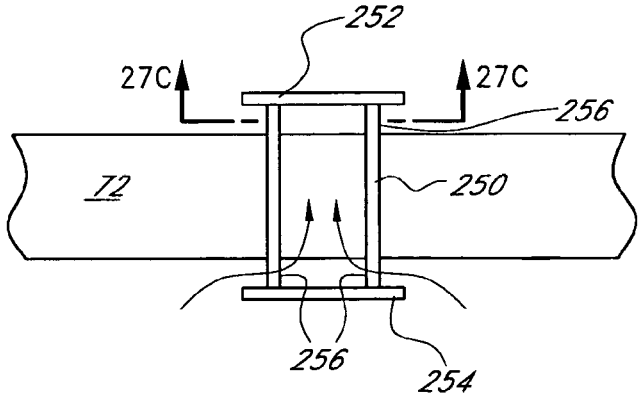
FIG. 27B is vertical sectional view of the ceiling-floor vent of FIG. 27A, embedded within a planar dividing structure.
Figure 27A:
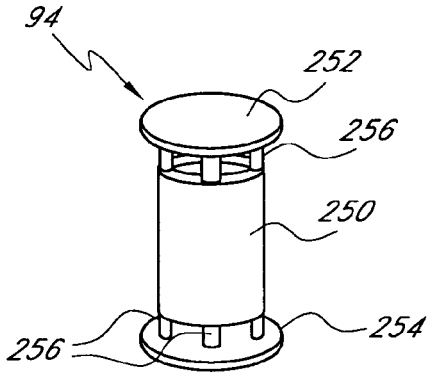
FIG. 27A is a perspective view of a ceiling-floor vent according to one embodiment of the present invention.
Figure 27C:
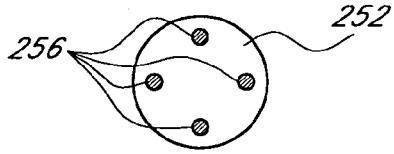
FIG. 27C is a sectional view of the ceiling-floor vent of FIGS. 27A and 27B, taken along line 27C-27C of FIG. 27B.

FIGS. 27A-C illustrate one embodiment of a ceiling-floor vent 94. With reference to FIG. 27A, the vent 94 comprises a cylinder 250, an upper cap 252 secured to an upper end of the cylinder 250, and a lower cap 254 secured to a lower end of the cylinder 250. The caps 252 and 254 are secured to the cylinder 250 in a manner that permits air to enter the cylinder 250 from one end and exit the cylinder from the other end. In the illustrated embodiment, the caps 252 and 254 are secured to the cylinder 250 by short spacer rods 256. FIG. 27B shows the vent 94 deployed in a horizontal dividing structure 72 that defines the ceiling of a room below and the floor of a room above. The cylinder 250 is embedded within the dividing structure 72 so that its ends extend above and below the upper and lower surfaces of the structure 72. As shown in FIG. 27C, the illustrated vent 94 includes four spacer rods 256 at each end of the cylinder 250. However, it will be understood that any number of spacer rods 256 (but preferably at least three for structural stability) can be provided at each end. The vent 94 can be installed by drilling a hole within the dividing structure 72, inserting the cylinder 250 therein (preferably with a relatively tight fit), and then securing the caps 252 and 254 to the cylinder 250 (e.g., by welding the caps and spacer rods 256 onto the cylinder 250). Optionally, a filler material (e.g., resinous material such as polyurethane or standard wall filler materials) can be provided between the cylinder 250 and the dividing structure 72 for improved adhesion, air-tightness, and/or stability.

Referring again to FIGS. 9 and 10, it will be understood that, in the building 64, each of the exterior walls 12, 13, 14, and 15, the interior walls 66 and 68, the bottom floor 44, the one or more horizontal structures 72, the ceiling 46, and the generally flat portions of the roof 16 includes a plurality of corner sections (as described above). Also, each of the interior rooms is defined by portions of walls (e.g., 12, 13, 14, 15, 66, 68), portions of a floor (e.g., 44), portions of a ceiling (e.g., 46), and/or portions of a horizontal structure (e.g., 72) intermediate the floor and ceiling. Each such wall portion, floor portion, ceiling portion, and horizontal structure portion also includes a plurality of corner sections within the room. As used herein, a corner section of a room refers to an intersection of three of the dividing structures (e.g., floor, ceiling, walls, horizontal structures) that define the contours of the room. Preferably, the passive ventilation system of the building 64 includes vents (wall-vents, floor-vents, ceiling-floor vents, ceiling-vents, and/or roof-vents) in the corner sections of the exterior walls 12, 13, 14, and 15, the floor 44, the ceiling 46, and the roof-portions 18 and 20 of the roof 16, as well as in the corner sections of the material layers that define the contours of the interior rooms of the building.

Each of the exterior walls 12, 13, 14, and 15 of the exterior wall structure 11 has a plurality of corner sections. Preferably, at least one of the exterior walls includes wall-vents 24 in at least half of the corner sections of that particular exterior wall. In another embodiment, each of the exterior walls includes wall-vents 24 in at least half of the corner sections thereof. In another embodiment, each of the exterior walls includes wall-vents 24 in all of the corner sections thereof. It is believed that passive ventilation through the exterior walls and of the entire building 64 will improve as the number of wall-vents 24 in corner sections of the exterior walls increases. In the illustrated embodiments, each exterior wall has four corner sections, preferably with wall-vents 24 in at least two of the corner sections thereof. In the embodiment depicted in FIGS. 9 and 10, each of the exterior walls 12, 13, 14, and 15 includes wall-vents 24 in all four of its corner sections. It will be understood that each exterior wall can have any number of corner sections, depending upon its shape and the design of the building 64.

Like the building 10 shown in FIG. 2, the roof 16 of the building 64 of FIGS. 9 and 10 includes two generally flat roof-portions 18 and 20 joined together at an upper ridge 22. Skilled artisans will understand that the roof 16 could include different numbers of generally flat roof-portions, depending upon the design of the building 64. Each of the roof-portions (e.g., 18 and 20) has a plurality of corner sections. Preferably, at least one of the roof-portions includes roof-vents 26 in at least half of the corner sections thereof. In another embodiment, each of the roof-portions includes roof-vents 26 in at least half of the corner sections thereof. In another embodiment, each of the roof-portions includes roof-vents 26 in all of the corner sections thereof. It is believed that passive ventilation through the roof 16 and of the entire building 64 will improve as the number of roof-vents 26 in corner sections of the roof-portions increases. In the illustrated embodiments, each roof-portion 18 and 20 has four corner sections, preferably with roof-vents 26 in at least two of the corner sections thereof. In the embodiment depicted in FIGS. 9 and 10, each roof-portion 18 and 20 includes roof-vents 26 in all four of its corner sections. It will be understood that each roof-portion can have any number of corner sections, depending upon its shape and the design of the building 64. It will also be understood that, while portions of the roof 16 may overhang the exterior walls of the building 64, the roof-vents 26 in corner sections of the roof-portions (e.g., 18 and 20) are distanced far enough from the edges of the roof so as to provide ventilation with the attic space 52.

With continued reference to FIGS. 9 and 10, the exterior wall structure 11, floor 44, interior walls (e.g., 66 and 68), ceiling 46, and horizontal structures 72 define a plurality of rooms of the building (e.g., the rooms 74, 76, 78, 80, 82, and 84). Generally, each room is defined at its top by a ceiling portion (e.g., ceiling portions 90 and 92 of rooms 82 and 84, respectively) comprising at least a portion of either the ceiling 46 or one of the horizontal structures 72. The ceiling portion of each room has a plurality of corner sections. Preferably, the ceiling portion of at least one of the rooms has either ceiling-vents 50 or ceiling-floor vents 94 (depending upon whether the ceiling portion is part of the ceiling 46 or a horizontal structure 72) in at least half of the corner sections of that ceiling portion. In another embodiment, the ceiling portion of at least one of the rooms has ceiling-vents 50 or ceiling-floor vents 94 (vents 50 and 94 are collectively referred to in this paragraph as "ceiling-vents" for simplicity) in all of the corner sections of that ceiling portion. In another embodiment, a majority of the rooms have ceiling-vents in at least half of the corner sections of the ceiling portion of the room. In another embodiment, a majority of the rooms have ceiling-vents in all of the corner sections of the ceiling portion of the room. In another embodiment, each of the rooms has ceiling-vents in all of the corner sections of the ceiling portion of the room. It is believed that passive ventilation through the rooms' ceiling portions and of the entire building 64 will improve as the number of ceiling-vents in corner sections of the rooms' ceiling portions increases. In the illustrated embodiments, each room is generally rectangular and thus each room's ceiling portion has four corner sections, preferably with vents 50 or 94 in at least two of the corner sections thereof. In the embodiment depicted in FIGS. 9 and 10, each room's ceiling portion includes vents 50 or 94 in all four of its corner sections. It will be understood that a room's ceiling portion can have any number of corner sections, depending upon its shape and the design of the building 64.

With continued reference to FIGS. 9 and 10, each room of the building 64 is defined at its bottom by a floor portion (e.g., floor portions 86 and 88 of rooms 74 and 76, respectively) comprising at least a portion of either the bottom floor 44 or one of the horizontal structures 72. The floor portion of each room has a plurality of corner sections. Preferably, the floor portion of at least one of the rooms has either floor-vents 64 or ceiling-floor vents 94 (depending upon whether the floor portion is part of the floor 44 or a horizontal structure 72) in at least half of the corner sections of that floor portion. In another embodiment, the floor portion of at least one of the rooms has floor-vents 64 or ceiling-floor vents 94 (vents 64 and 94 are collectively referred to in this paragraph as "floor-vents" for simplicity) in all of the corner sections of that floor portion. In another embodiment, a majority of the rooms have floor-vents in at least half of the corner sections of the floor portion of the room. In another embodiment, a majority of the rooms have floor-vents in all of the corner sections of the floor portion of the room. In another embodiment, each of the rooms has floor-vents in all of the corner sections of the floor portion of the room. It is believed that passive ventilation through the rooms' floor portions and of the entire building 64 will improve as the number of vents 64 or 94 in corner sections of the floor portions increases. In the illustrated embodiments, each room is generally rectangular and thus each room's floor portion has four corner sections, preferably with vents 64 or 94 in at least two of the corner sections thereof. In the embodiment depicted in FIGS. 9 and 10, each room's floor portion includes vents 64 or 94 in all four of its corner sections. It will be understood that a room's floor portion can have any number of corner sections, depending upon its shape and the design of the building 64. It will also be understood that floor-vents 64 may be omitted from the bottom floor 44 if the bottom floor is not elevated above the foundation 48 to create an airspace 60 therebetween.

With continued reference to FIGS. 9 and 10, each room of the building 64 is defined at its sides by a plurality of wall portions. Each wall portion of a room comprises at least a portion of one of the exterior walls (e.g., 12, 13, 14, 15) or interior walls (e.g., 66, 68). Each wall portion of a room includes a plurality of corner sections. Preferably, at least one of the wall portions of at least one of the rooms has wall-vents 24 or 70 (depending upon whether the wall portion forms a portion of the exterior wall structure 11 or one of the interior walls of the building) in at least half of the corner sections of that wall portion. In another embodiment, each of the wall portions of at least one of the rooms has wall-vents 24 or 70 in at least half of the corner sections of that wall portion. In another embodiment, each of the wall portions of at least one of the rooms has wall-vents 24 or 70 in all of the corner sections of that wall portion. In another embodiment, each of the wall portions of a majority of the rooms has wall-vents 24 or 70 in at least half of the corner sections thereof. In another embodiment, each of the wall portions of a majority of the rooms has wall-vents 24 or 70 in all of the corner sections thereof. In another embodiment, each of the wall portions of each of the rooms has wall-vents 24 or 70 in all of the corner sections thereof. It is believed that passive ventilation through the rooms' wall portions and of the entire building 64 will improve as the number of wall-vents 24 or 70 in corner sections of the wall portions increases. In the illustrated embodiment, each room is generally rectangular and thus each room's wall portions have four corner sections. In the embodiment depicted in FIGS. 9 and 10, each room's wall portion includes wall-vents 24 or 70 in all four of its corner sections. It will be understood that a wall portion of a room can have any number of corner sections, depending upon its shape and the design of the building 64.

Figure 11:
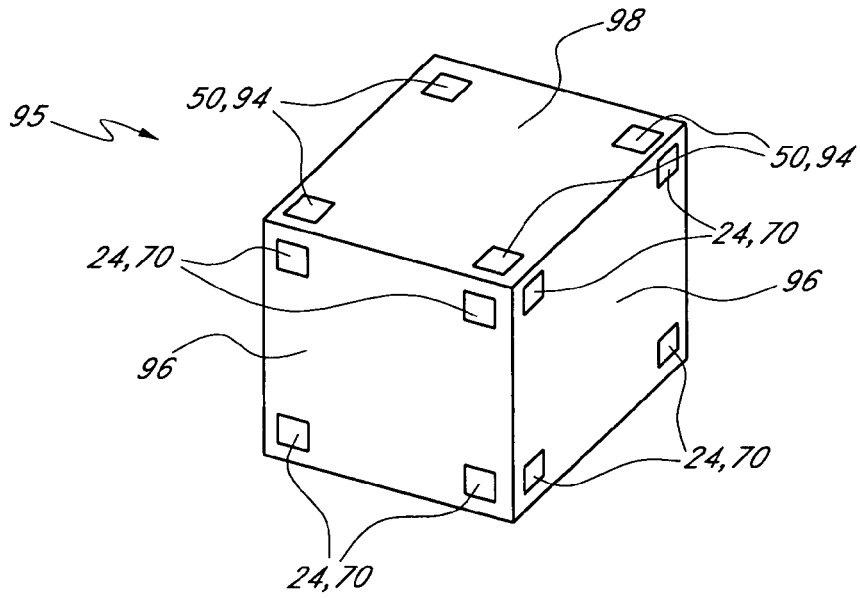
FIG. 11 is a perspective view of a representation of an internal room of a building with a system of vents according to one embodiment of the present invention.

FIG. 11 is a representational view of a room 95 of a building according to one embodiment of the invention. The illustrated 95 room is rectangular, but those of skill in the art will understand that a room can have a wide variety of different shapes and sizes, depending upon the design of the room and the building. The illustrated room 95 includes wall portions 96 that may comprise portions of the exterior wall structure of the building (e.g., walls 12, 13, 14, or 15 of FIGS. 9 and 10) or portions of interior walls (e.g., walls 66 or 68 of FIGS. 9 and 10). The wall portions 96 preferably include wall-vents 24 or 70 in the corner sections thereof. The illustrated room 95 also includes a ceiling portion 98, which may comprise a portion of a building ceiling (e.g., ceiling 46 of FIG. 9) or a portion of a horizontal structure (e.g., horizontal structure 72 of FIG. 9). The ceiling portion 98 preferably includes ceiling-vents 50 or ceiling-floor vents 94 in the corner sections thereof. Although not shown, skilled artisans will understand that the illustrated room 95 also includes a floor portion at its bottom, which may comprise a portion of a bottom floor of the building (e.g., bottom floor 44 in FIG. 9) or a portion of a horizontal structure (e.g., horizontal structure 72 of FIG. 9). The floor portion preferably includes floor-vents or ceiling-floor vents 94 in the corner sections thereof.

It will be understood that the degree of passive ventilation within a building of the present invention can be affected by controlling the number and sizes of the various vents described above. It can also be affected by controlling the positioning of the vents. For example, the ventilation can be improved by generally vertically aligning two or more of the floor-vents, ceiling-vents, and ceiling-floor vents, which promotes substantially vertical airflow paths through multiple stories of the building. Each vertical flow of air through a room draws air from the airspace laterally displaced from the vertical flow paths. Preferably, the roof-vents 26, ceiling-vents 50, ceiling-floor vents 94, and floor-vents 64 (or combinations thereof) are aligned substantially vertically throughout a substantial portion of the height of the building (or more preferably throughout substantially the entire height of the building) at one or more horizontal positions of the building, to thereby produce one or more substantially vertical flows of air upward and out through the ceiling and/or roof of the building, without the use of ventilation stacks.

Figure 12:
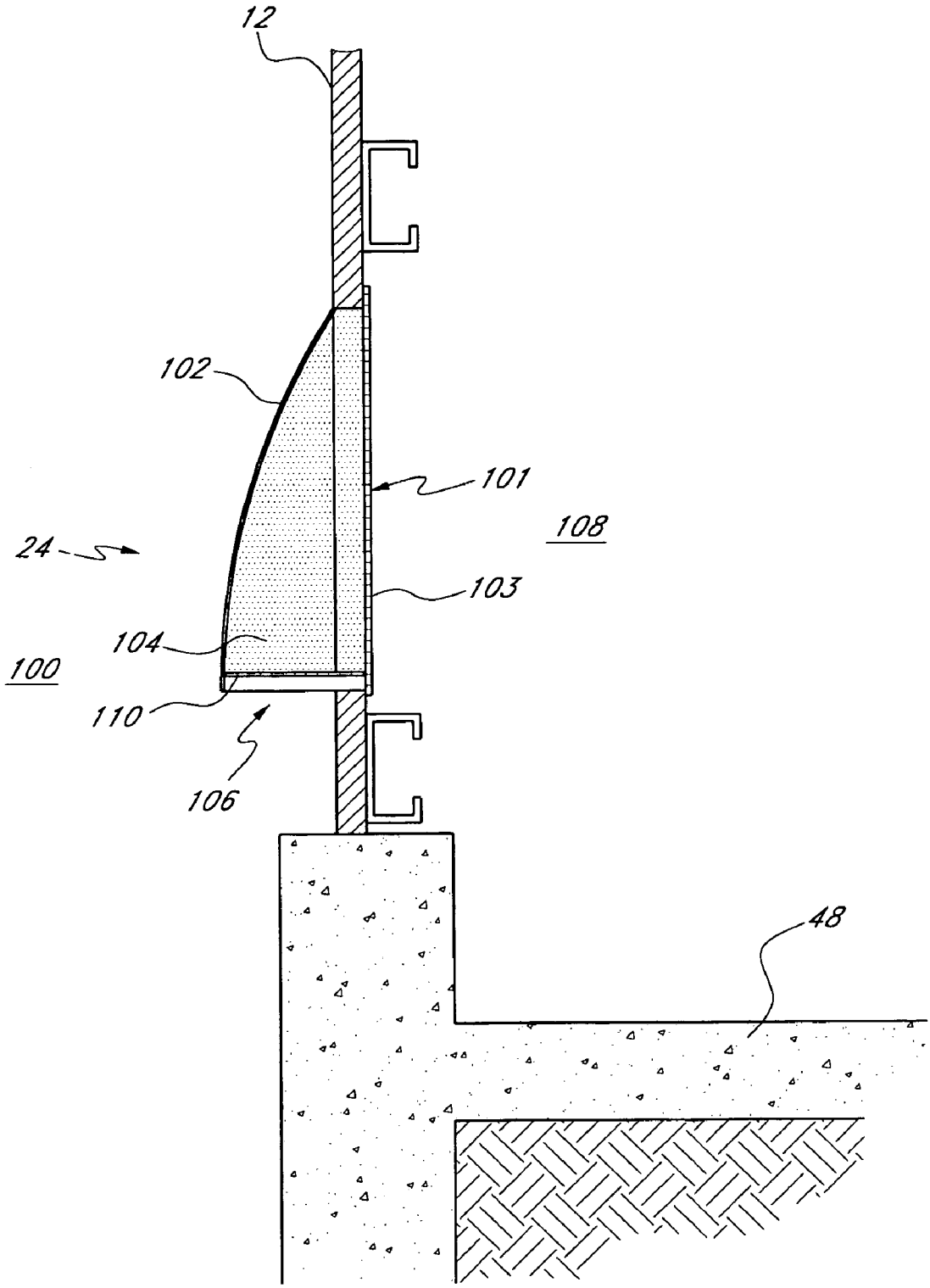
FIG. 12 is a cross-sectional side view of an exterior wall-vent filter shown in FIG. 5.

FIG. 12 shows a wall-vent 24 for use in an exterior wall 12 of a building, according to one embodiment of the invention. In the illustrated embodiment, the exterior wall 12 is formed on a foundation 48 and includes an opening 101 within which the wall-vent 24 is positioned. The wall-vent 24 permits airflow between a building exterior 100 and a building interior 108. The illustrated wall-vent 24 includes an outwardly depending skirt 102, forming an opening 106 at its bottom end. A screen or other type of filtering apparatus 103 may be provided at the interior opening 101 of the wall 12. Likewise, a screen or other type of filtering apparatus 110 may be provided at the opening 106 of the skirt 102. Preferably, a filter 104 is provided at the interior of the skirt 102 so that air must flow through the filter 104 if it is to flow between the building exterior 100 and the building interior 108. The filter 104 may comprise spun plastic, metallic mesh (preferably with openings no greater than ¼ inch), plastic screen, mosquito fine netting (perhaps on chicken wire support), or like materials. The filter 104 can optionally include a louvered cover configured to be completely opened or closed. Preferably, the wall-vent 24 is configured to prevent the ingress of one or more of a variety of different substances and life forms, such as vermin, insects, water, leaves, dust, etc. It will be understood that the roof-vents 26, floor-vents 64, and underfloor-vents 62 can also include filters for preventing the ingress of various substances and life forms.

With respect to all of the vents described above, it will be understood that there are a wide variety of different types of vents that can be used. For example, the roof-vents 26 can be translucent to allow sunlight to enter the home. On tile-roofs, the roof-vents 26 can be configured to visually blend in with the tiles. It is believed that the principles of the present invention apply regardless of the specific types of vents employed. Preferably, the roof-vents 26, ceiling-vents 50, and ceiling-floor vents 94 are dividing-structure vents, as described herein. Preferably, the floor-vents 64 are also dividing-structure vents.

Figure 13:
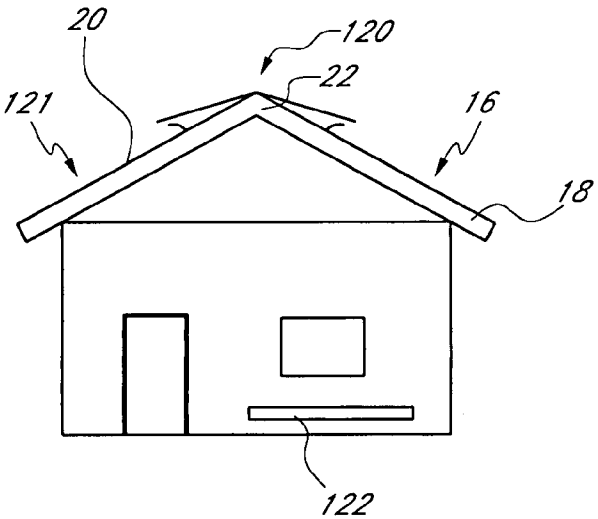
FIG. 13 is a front view of a building with a ridgeline roof vent according to one embodiment of the invention, along with one or more elongated wall vents.

As mentioned above, the degree of passive ventilation can be adjusted by varying the sizes of the various vents. One way to do that is to provide elongated vents, which leads to more air flow. FIG. 13 shows a building 121 having an elongated roof vent and one or more elongated wall vents 122. The illustrated roof vent comprises a roof ridge line vent 120 that extends along a desired length of the ridge 22 of the roof 16, and which provides reduced risk of water leakage compared to conventional roof vents. It will be understood that other types of elongated roof vents can also be used. In addition to the roof vent 120 and wall vent 122, other vents can also be elongated, such as wall vents on the other exterior walls and/or the interior walls, floor vents, ceiling vents, ceiling-floor vents, and/or other roof vents. It is believed that elongated vents may be preferred in tropical climates, in which temperature variations are not great. Elongated vents might be less desirable in cooler climates, in order to reduce heat loss from the building. In one embodiment, the elongated wall vents 122 include filters, such as the filter 104 (FIG. 12) described above. In one embodiment, the filter comprises mosquito netting supported on chicken wire, which is relatively inexpensive. In one embodiment, the wall vent 122 is about 4-15 inches in vertical height and 6-30 inches in length.

With continuing reference to FIG. 13, the illustrated roof vent 120 comprises a roof ridgeline vent that extends along a desired length of the ridge 22 of the roof 16, and which provides reduced risk of water leakage compared to conventional roof vents. Since the roof vent 120 is elongated along at least a portion of the roof's ridge 22, the vent 120 provides for generally increased ventilation. It is believed that the elongated roof ridgeline vent 120 may be preferred in tropical climates, in which temperature variations are not great and where there is less concern over reducing heat loss from the building. The roof ridgeline vent 120 can be provided in buildings having attics as well as buildings with vaulted ceilings and no attics.

Figure 15:
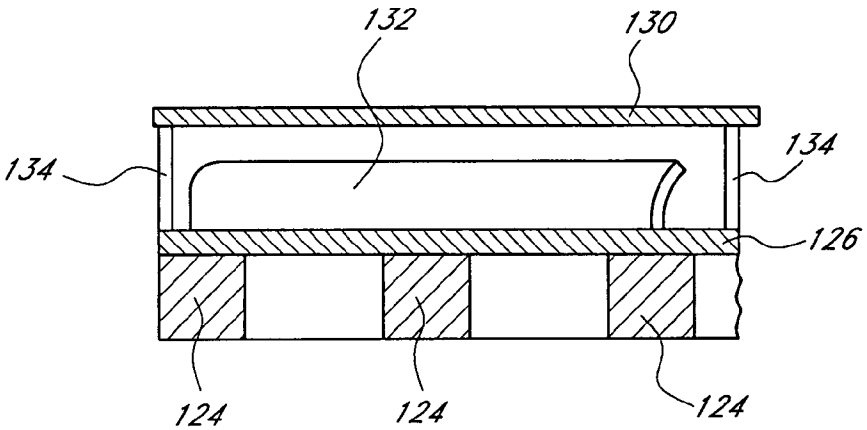
FIG. 15 is a partial cut-away cross-sectional view taken along line 15-15 of FIG. 14.
Figure 14:
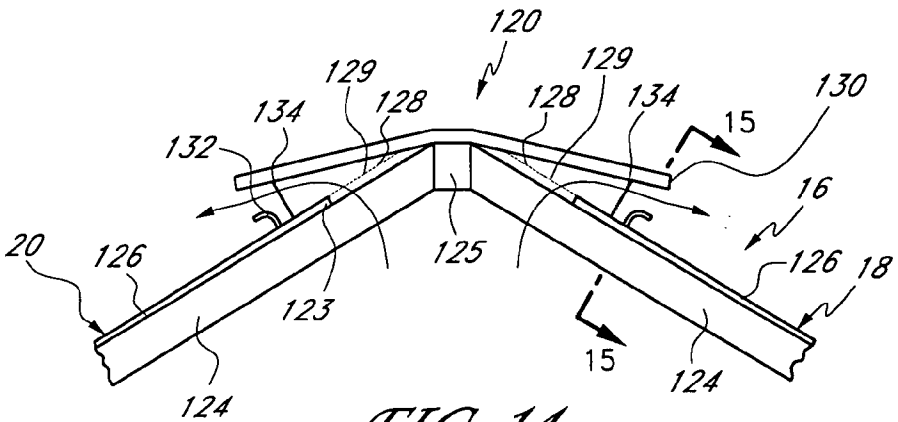
FIG. 14 is an enlarged cross-sectional view of the ridgeline roof vent of FIG. 13.

FIGS. 14 and 15 illustrate the roof ridgeline vent 120 of FIG. 13 in more detail. FIG. 14 is an enlarged cross-sectional view of the top of the roof 16, and FIG. 15 is a partial cross-sectional view taken along line 15-15 of FIG. 14. The illustrated roof 16 includes the two sloped roof-portions 18 and 20, each of which comprises a plurality of sloped rafters 124 with upper ends joined with a ridge beam 125. The ridge beam 125 essentially defines the ridge 22 of the building 121. Although not shown, the roof 16 may also comprise purlins (beams extending perpendicularly to the plane of FIG. 14). In each roof-portion 18 and 20, the rafters 124 and purlins are covered by a roof-cover 126, as known in the art. However, in each roof-portion 18, 20, the roof-cover 126 does not extend completely to the ridge beam 125, such that an opening 128 is defined between the end 123 of the roof-cover 126 and the ridge beam 125. Optionally, screens 129 (shown as dotted lines in FIG. 14) may be provided from the upper ends 123 of the roof-covers 126 to the ridge beam 125. It will be understood that different or additional screens (i.e., different or in addition to those shown in dotted lines) may be deployed to prevent the ingress of materials through the roof vent 120. Preferably, there are no openings or roof-vents in the roof-cover 126 except for the opening 128. However, the presence of such additional openings or roof-vents is possible and is within the scope of the invention.

Figure 16:
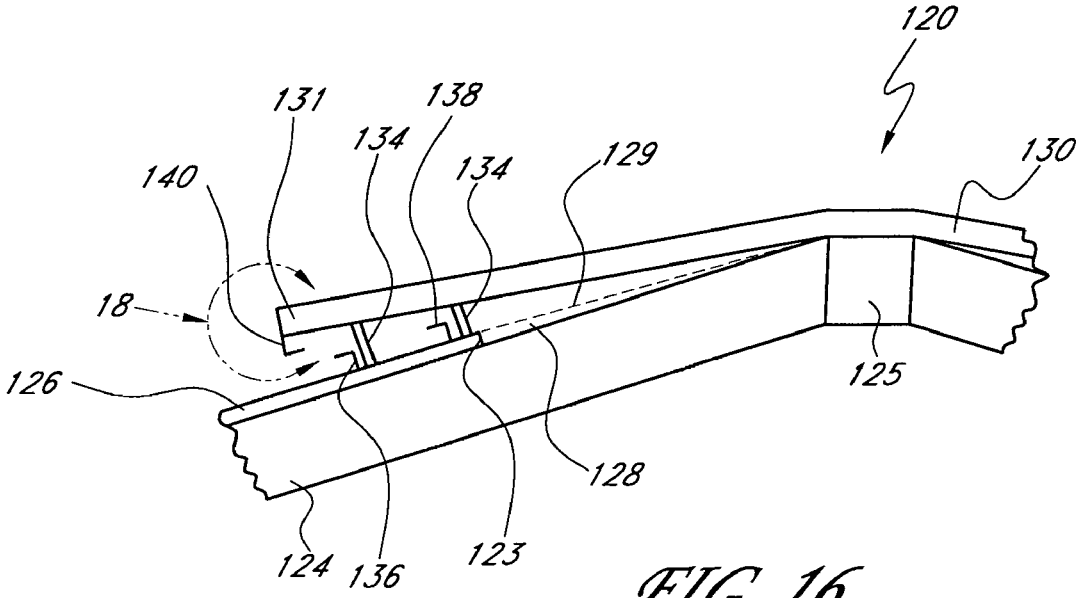
FIG. 16 is an enlarged view of a portion of the ridgeline roof vent of FIG. 14, according to an alternative embodiment.

The ridgeline vent 120 comprises a cover or canopy 130 (or vent cap) secured above the ridge beam 125. As used herein, the term "canopy" means a cover for an opening in a roof-cover, and encompasses a wide variety of different shapes and sizes. In the dimension of the ridge beam 125, the canopy 130 is preferably coextensive or longer than the openings 128. The illustrated canopy 130 extends diagonally downward along each of the two sloped roof-portions 18, 20. Preferably, the canopy 130 extends laterally beyond the upper ends 123 of the roof-covers 126. More preferably, the ends of the canopy 130 are vertically below the upper ends 123 of the roof-covers 126, which helps to prevent the ingress of horizontal wind-driven rain through the roof vent 120. With respect to each roof-portion 18, 20, the illustrated canopy 130 descends at a different angle than the roof-portion, such that there is an angular separation therebetween. In a preferred embodiment, such angular separation is less than 20°, and more preferably between 15-20°. Preferably, spacers 134 are provided on each side of the ridge beam 125 for maintaining a displacement between the canopy 130 and the roof-covers 126. The spacers 134 may comprise any of a variety of different shapes, sizes, and structures, giving due consideration to the goal of maintaining said separation between the canopy 130 and the roof-covers 126, as well as providing room for baffles 132 that extend preferably along substantially the entire length of the vent 124 (in the same dimension as the ridge beam 125). The baffles 132 are secured to the roof-covers 126 underneath the canopy 130, and preferably extend upward and outward away from the ridge beam 125. The baffles 132 can be curved as shown in FIGS. 14 and 15, or rectangular like the baffles 136, 138, and 140 shown in FIGS. 16-18. Other shapes for the baffles are also possible, keeping in mind the functional goals of the baffles taught herein. The baffles 132 are preferably designed to prevent the ingress of horizontal wind-driven rain through the roof vent 120, by blocking any direct line of sight through the vent 120 into the building. The spacers 134 can be on either side of the baffles 132 (i.e., above or below). In FIG. 16, the ends of the illustrated baffle 132 are cut away to show the spacers 134. While a variety of different securing methods can be employed, the canopy 130 is preferably welded to the spacers 134, ridge beam 125, and/or other roof elements. The spacers 134 and baffles 132 are preferably likewise welded to the roof-cover 126 or other elements. The canopy 130 can be formed of any of a variety of different materials, such as polycarbonate. It will be understood that the ridgeline vent 120 concept can be used in roof ridges that are non-linear, such as ridges that are curved or have a plurality of linear segments. Any number of baffles can be provided on each side of the ridge 22.

The illustrated roof ridgeline vent 120 may extend along a portion or substantially the entire length of the ridge 22 of the building 121. In use, air flows upward from below the roof 16, between the rafters 124, through the openings 128 and screens 129, and then outward underneath the canopy 130 and over the baffles 132. The upper ends 123 of the roof-covers 126 are preferably about 12-18 inches from the ridge beam 125. On each sloped roof-portion 18, 20, the canopy 130 preferably extends downward about 12-18 inches past the upper end 123 of the roof-cover 126. The screens 129 are preferably configured to prevent the ingress of various lifeforms and substances, such as vermin, insects, plants, water, dust, etc. The baffles 132 help prevent wind-driven rain from flowing through the openings 128 into the building 121. In one embodiment, the canopy 130 is partially or completely translucent, thereby acting as a skylight.

It will be understood that other roof shapes are possible. For instance, the roof may be round, frustoconical, or another shape other than two flat portions joined at a linear ridge. In one configuration, the roof cover is sloped downward as if from an upper apex. The roof-cover has an upper edge terminating under the apex and circumscribing a vertical line passing through the apex so as to define an upper opening in the roof-cover. In this configuration, the roof further comprises a cover or canopy positioned over the opening and configured to prevent rainwater from entering the opening. The cover is spaced above the roof-cover to permit airflow between an airspace below the roof-cover and an airspace above the roof-cover. Screens, filters, and baffles (e.g., circular or curved baffles) can also be provided, conforming to such geometry. Thus, a round roof can have a rooftop vent comprising a conical canopy or vent cap covering an encircling roof opening and an encircling set of one or more baffles.

Figure 17:
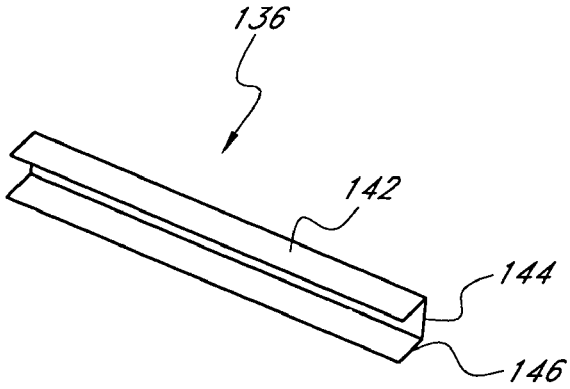
FIG. 17 is a perspective view of a baffle of the ridgeline roof vent of FIG. 16.

In an alternative embodiment, shown in FIGS. 16 and 17, the ridgeline vent 120 includes a system of baffles 136, 138, and 140 on each side of the ridge beam 125. It should be noted that FIG. 16 is not necessarily drawn to scale. In the illustrated embodiment, the baffles 136 and 138 are secured to the roof-cover 126, and the baffle 140 is secured at the edge 131 of the canopy 130. The illustrated baffles 136, 138, and 140 are preferably sized and configured so that outside air flowing into the building 121 cannot flow in a straight line across all three baffles. In other words, the air must turn. Each baffle is preferably configured so that its portion that protrudes from the roof-cover 126 or canopy 130 is rectangular or L-shaped. In a preferred embodiment, each baffle has a U-shaped cross-section, wherein one side of the "U" can be secured to the roof-cover 126 or canopy 130. For example, FIG. 17 shows a portion of a baffle 136 having a rectangular U-shaped cross-section defined by an upper portion 142, a center portion 144, and a lower portion 146. In the illustrated embodiment, the lower portion 146 is secured (e.g., by welding) to the roof-cover 126. The upper and center portions 142 and 144 form an L-shaped protrusion from the roof-cover 126. The baffle 136 shown in FIG. 17 can be an extruded piece of metal. The baffles 136 and 138 can be substantially identical. Further, the baffle 140 can also have a U-shaped cross-section and can also be an extruded piece of metal. The illustrated baffle system helps to prevent outside air from flowing under the canopy 130 and into the building 121. The air tends to get blocked by the upper portions (e.g., 142) of the baffles 136 and 138. It will be understood that any number of baffles 136, 138 can be employed. More generally, it will be understood that any number of baffles can be provided on either side of the ridge beam 125, and the baffles can be secured to the roof-covers 126 or the canopy 130.

Figure 18:
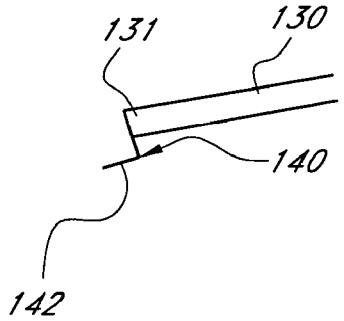
FIG. 18 is an enlarged view of a portion of the ridgeline roof vent of FIG. 16 in the area indicated by arrow 18, according to yet another alternative embodiment.

With continued reference to FIG. 16, the baffle 140 has a lower portion extending inward toward the ridge beam 125. The baffle 140 could alternatively have a lower portion extending outward away from the ridge beam 125. For example, FIG. 18 shows the baffle 140 having a lower portion 142 directed away from the ridge beam 125.

Figure 19:
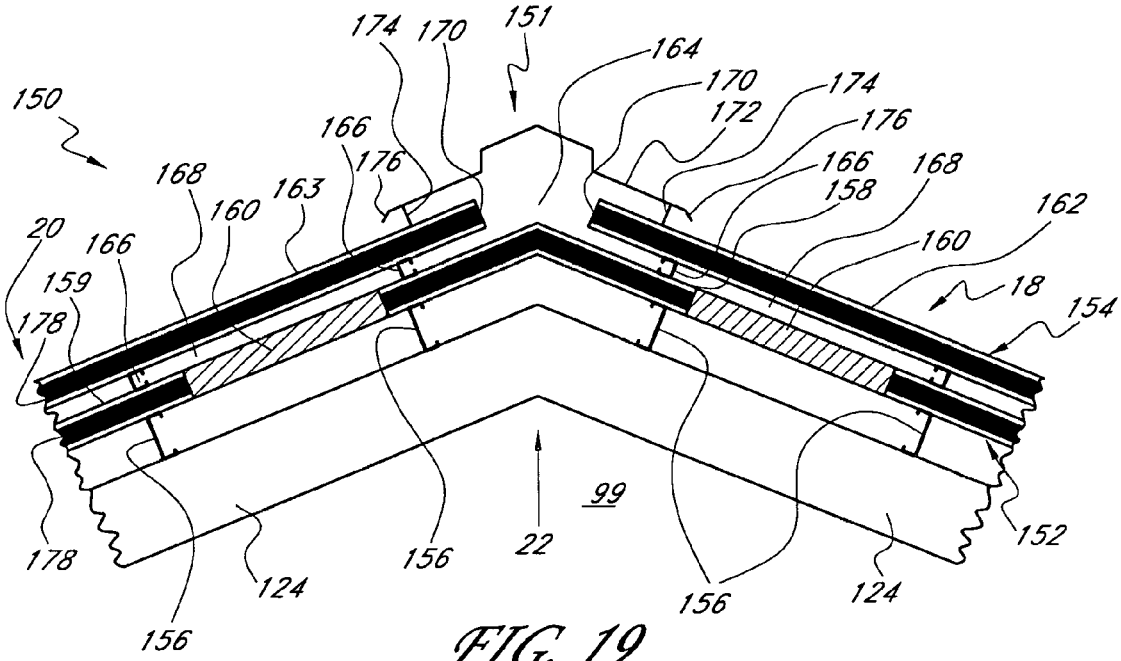
FIG. 19 is a cross-sectional view of an upper portion of a roof and ridgeline roof vent according to another embodiment of the present invention.

FIG. 19 is a cross-sectional view of an upper portion of a roof 150 according to another embodiment of the present invention. As in the embodiment shown in FIG. 14, the roof 150 comprises a first sloped roof-portion 18 and a second sloped roof-portion 20. Each of the roof-portions 18, 20 comprises a plurality of sloped rafters 124, the upper ends of which meet at the ridge 22 of the roof 150. It will be understood that, in addition to the illustrated rafters 124 of FIG. 19, there are additional rafters 124 in planes parallel to the plane of the figure. While FIG. 19 does not show a ridge beam extending along and defining the ridge 22 (as in the embodiment of FIG. 14), it will be understood that a ridge beam is preferably provided. Preferably, the roof 150 includes a ridgeline vent 151, described in greater detail below. The roof 50 can be provided on buildings having attics as well as buildings with vaulted ceilings and no attics.

The roof 150 further comprises a lower or first roof-cover 152 and an upper or second roof-cover 154. Each roof-cover 152, 154 includes a separate segment for each of the two roof-portions 18, 20. The first roof-cover 152 comprises a first segment 158 that forms a part of the first roof-portion 18, and a second segment 159 that forms a part of the second roof-portion 20. In the illustrated embodiment, the upper ends of the segments 158 and 159 are joined together at the ridge 22 of the roof 150. Preferably, the upper ends of the segments 158 and 159 are joined together in a substantially air-tight connection, which can be effected by the use of epoxies, adhesives, tapes, flexible joint elements (e.g., rubber), and the like. The first roof-cover 152 is supported on a plurality of purlins 156 that are positioned on and preferably secured to the rafters 124. The illustrated purlins 156 are oriented generally parallel to the ridge 22 and generally perpendicular to the rafters 124. It will be understood that, in each roof-portion 18, 20, the number of purlins 156 can be selected based upon the size of the roof-portion and the extent of support needed for the roof-covers 152 and 154 (both of whose weight is felt by the purlins 156). In the illustrated embodiment, the purlins 156 have C-shaped cross-sections and can be formed by metal extrusion. The purlins 156 preferably have openings (e.g., holes, slots, or the like) therein to permit the flow of air through the purlins, as discussed below. The bottom surface of the first roof-cover 152 defines a ceiling of a space 99, such as an attic.

With continued reference to FIG. 19, the first roof-cover 152 includes a plurality of vents or "subflashings" 160 that permit air to flow through the roof-cover 152. Preferably, the vents 160 are arranged generally evenly throughout the first roof-cover 152. The density of vents 160 in the surface of the first roof-cover 152 is preferably at least one vent per 300 $ft^2$, more preferably at least one vent per 200 $ft^2$, even more preferably at least one vent per 100 $ft^2$, and even more preferably at least one vent per 50 $ft^2$. Each vent 160 preferably includes a surrounding lip whose height is preferably at least about ⅝ inch, to hinder the flow of water through the vent into the building. The vents 160 preferably include screens to prevent larger materials from passing through them. Any of a wide variety of different types of vents 160 can be used, keeping in mind the desired size constraints of the vents. For example, the vents 60 can comprise the lower or "subflashing" portion of the roof vent illustrated and described in U.S. Pat. No. 6,447,390, the full disclosure of which is incorporated herein by reference. Suitable types of vents 160 are sold by O'Hagins, Inc. of Sebastopol, Calif.

The second roof-cover 154 comprises a first segment 162 that forms a part of the first roof-portion 18, and a second segment 163 that forms a part of the second roof-portion 20. The second roof-cover 154 (e.g., the roof segments 162 and 163) can be secured above the first roof-cover 152 in a variety of different methods, including without limitation screws, nut-and-bolt combinations, welding, etc., keeping in mind the goal of a strong enough connection to withstand severe weather conditions (such as storms, high winds, etc.). In some embodiments, the second roof-cover 154 is configured to selectively attachable and detachable with respect to the first roof-cover 152, permitting its removal for cleaning of the first roof-cover, as well as replacement of screens and other elements. The second roof-cover 154 can be secured directly to the first roof-cover 152 or to intermediate elements (such as the purlins 166 discussed below). In the illustrated embodiment, the upper ends 170 of the segments 162 and 163 do not extend all the way to the ridge 22 and are thus separated from one another to form an elongated opening 164. Preferably, the upper ends 170 are displaced about 12-18 inches from the ridge 22. Preferably, there are no openings or roof-vents in the upper roof-cover 154 except for the opening 164. However, the presence of such additional openings or roof-vents is possible and is within the scope of the invention.

Figure 20A:
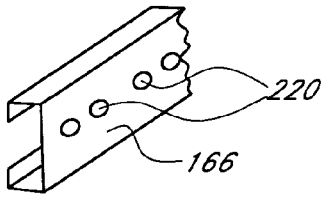
FIG. 20A is an enlarged view of an embodiment of a purlin of the roof of FIG. 19.
Figure 20B:
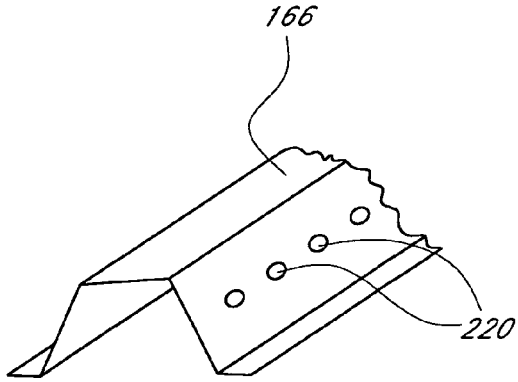
FIG. 20B is an enlarged view of a different embodiment of a purlin of the roof of FIG. 19.

The second roof-cover 154 is supported on a plurality of purlins 166 that are positioned on and preferably secured to the first roof-cover 152. Like the purlins 156, the purlins 166 are oriented generally parallel to the ridge 22 and generally perpendicular to the rafters 124. It will be understood that, in each roof-portion 18, 20, the number of purlins 166 can be selected based upon the size of the roof-portion and the extent of support needed for the second roof-cover 154. As illustrated in FIG. 20A, the purlins 166 can have C-shaped cross-sections and can be formed by metal extrusion. The purlins 166 preferably have openings 220 therein to permit the flow of air across the purlins, as discussed below. FIG. 20B shows a different embodiment of a trapezoidally-shaped purlin 166, which also has openings 220 and can be formed by metal extrusion. The purlins 156 can also be as shown in FIGS. 20A and 20B. The purlins 156, 166 as shown in FIGS. 20A and 20B can optionally include a filter (e.g., a screen can be wrapped around the purlins). Alternatively, the purlins 156 can be of a type that does not permit airflow through the purlins. Skilled artisans will appreciate that any of a variety of different purlin designs can be chosen. Preferably, the purlins 166 are substantially aligned with the purlins 156, which provides for greater stability and load transfer through the two-layer stack of purlins down to the rafters 124. However, it will be understood that the purlins 156 and 166 need not be aligned as shown in FIG. 19. Alternatively or in addition to the purlins 166, an additional layer of rafters can also be provided between the two roof-covers 152 and 154.

In the illustrated embodiment, the purlins 166 are smaller than the purlins 156. However, it will be understood that the purlins 156 and 166 can have the same size, or the purlins 166 can be larger. As seen in FIG. 19, a thin gap or airspace 168 is formed between the two roof-covers 152 and 154. In the illustrated embodiment, the airspace 168 comprises a first generally planar portion in the first roof-portion 18 and a second generally planar portion in the second roof-portion 20. The size of the purlins 166 is preferably large enough to provide a sufficient air-insulation layer 168, yet not so large as to result in an undesirably large roof thickness. The thickness of the air layer 168 is preferably large enough to allow for a sufficient volume and rate of airflow therein, to meet desired ventilation goals. Further, in applicable jurisdictions the air layer 168 thickness preferably meets relevant code requirements relating to "Net Free Vent Area." The thickness of the air layer 168 is preferably less than about six inches and greater than about ¾ inch. The air layer 168 thickness is more preferably within a range of about one to six inches, more preferably within about three to six inches, and even more preferably within about three to four inches.

With continued reference to FIG. 19, the ridgeline vent 151 comprises an elongated canopy or vent cap 172 formed above the opening 164 of the second roof-cover 154. The canopy 172 can be substantially similar to the canopy 130 described above with respect to the embodiment of FIG. 14. The ridgeline vent 151 preferably also includes some combination of baffles, such as the baffles 132, 136, 138, and/or 140 as shown in FIGS. 14-18. Further, an additional type of baffle structure is shown on the canopy 172 of FIG. 19. The ends 176 of the illustrated canopy 172 are bent downward toward the second roof-cover 154 to form a baffle structure that inhibits to some extent the flow of air from above the building downward through the ridgeline vent 151.

The ridgeline vent 151 can also include spacers for maintaining a desired displacement between the canopy 172 and the second roof-cover 154. In the illustrated embodiment, the ridgeline vent 151 includes spacers 174. In one embodiment, the spacers 174 comprise elongated screens configured to allow air through-flow while preventing the through-flow of larger scale matter such as leaves, vermin, etc. Such screens 174 preferably extend along substantially the entire length of the ridgeline vent 151. The screens 174 can include a rigid frame with an enclosed screen material or netting. Alternatively, other types of spacers 174 can be provided. If the spacers 174 are not screens, then an elongated screen is preferably provided at the opening 164 to permit air through-flow while preventing the through-flow of larger matter. Of course, it will also be understood that different and/or additional screens may be provided in other locations underneath the canopy 172, to provide different degrees of resistance to ingress of certain materials through the vent 151. In one embodiment, the spacers 174 comprise purlins with openings or recesses that allow the through-flow of air, such as the purlins 166 shown in FIGS. 20A and 20B. Such spacers can be wrapped in screen or netting as discussed above.

In a preferred embodiment, one or both of the roof-covers 152 and 154 is a multiple-layer construction including at least one layer of insulation material 178. In the illustrated embodiment, each roof-cover 152 and 154 includes a single layer of insulation material 178 (shown as a darkened layer of the roof-covers) between two other layers. Another preferred configuration is a two-layer roof-cover having a top layer of metal or alloy over a bottom layer of insulation material 178. The insulation material 178 is preferably configured to reflect solar radiation (particularly ultraviolet radiation) away from the roof 150. In use, solar radiation may penetrate through other layers of the roof-covers 152 and 154, but is reflected away by insulation material 178. Absent the insulation material 178, the radiation would tend to heat up the roof 150, which in turn would raise the temperature of the space 99 to an undesirably high level. The insulation material 178 also advantageously keeps ultraviolet light rays from hitting people within the building. A preferred insulation material 178 includes aluminum. A preferred insulation layer 178 is a plastic bubble blanket whose sides are covered by aluminum foil, which is often available in rolls about four feet wide. Another benefit of the insulation layers 178 is that they act as a barrier against various types of noises, such as the sound of hard rain landing upon the roof 150. Preferably, both roof-covers 152 and 154 include at least one layer of insulation material 178.

Figure 26:
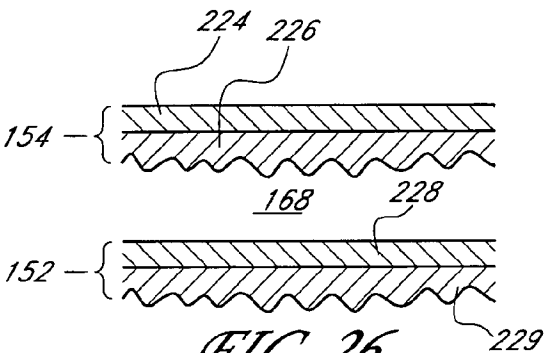
FIG. 26 is an enlarged cross-section of the roof of FIG. 19, according to one embodiment of the present invention.

FIG. 26 is an exploded cross-sectional view of a portion of the roof 150, showing the two roof-covers 152 and 154 according to one embodiment of the invention. In this embodiment, the second roof-cover 154 preferably comprises an upper layer 224 of a strong material (e.g., steel) and a lower layer 226 of a radiant barrier. A suitable radiant barrier comprises aluminum foil or a flexible composite including aluminum, such as the aforementioned plastic bubble blanket. The first roof-cover 152 preferably comprises an upper layer 228 of a strong material (e.g., steel) and a lower layer of insulation (e.g., a flexible composite of foam and fiberglass). The air layer 168 is formed between the layers 226 and 228.

Figure 21A:
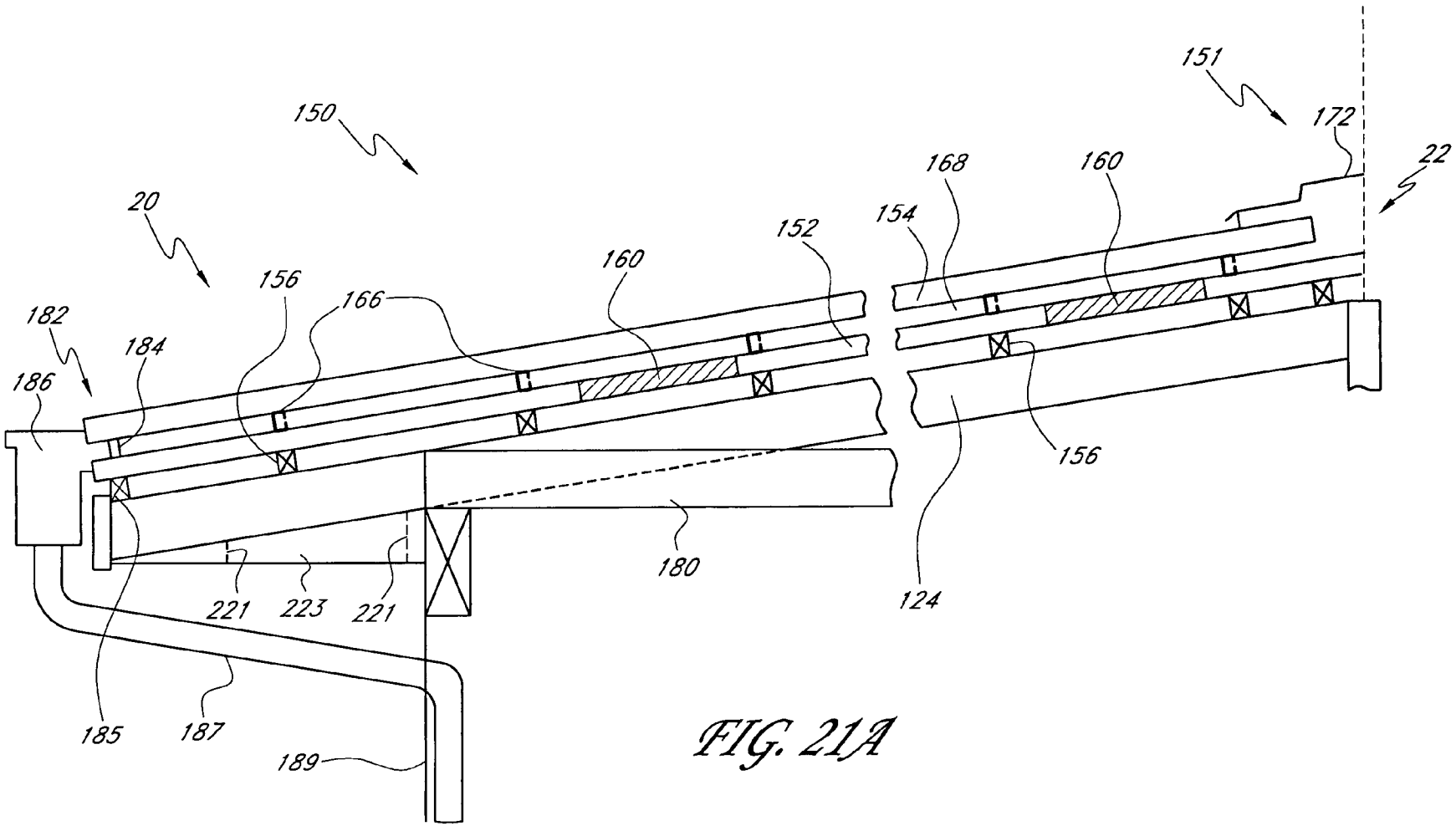
FIG. 21A is a cross-sectional view of a side portion of the roof of FIG. 19.

FIG. 21A shows the second sloped roof-portion 20 of the roof 150, which is supported by a ceiling 180. The building may or may not have an attic. For clarity and simplicity, the insulation layers 178 of the roof-portions 152 and 154 are not shown in FIG. 21A (however, they may be provided). The roof-portion 20 slopes downward from the ridge 22 to an eave 182. In a preferred embodiment, the eave 182 includes one or more "leading edge vents" 184. Each leading edge vent 184 permits airflow between the building exterior and the airspace 168 between the two roof-covers 152, 154. The eave 182 can have one leading edge vent 184 that extends across the entire edge, or alternatively a plurality of shortened leading edge vents 184 separated by air barriers. The eave 182 preferably includes a gutter 186 configured to receive rainwater that flows downward on the second roof-cover 154 and cascades over the edge thereof. The gutter 186 is preferably also configured to receive water than runs down the first roof-portion 152. In the illustrated embodiment, water collected in the gutter 186 runs down by gravity into a tube 187 attached to a sidewall 189 of the building, from which it drains out onto the ground, into a sewer, into a rainwater collection means for re-use, or the like. The gutter 186 also advantageously acts as a baffle or barrier against the ingress of horizontal wind-driven rain into the air layer 168.

The eave 182 can have a variety of different configurations for permitting exterior airflow into the region below the first roof-cover 152. In a first configuration, one or more "soffits" or "undereave vents" 223 are positioned underneath the portions of the rafters 124 that overhand the building sidewall 189. In the illustrated embodiment, each undereave vent 223 provides a passage for vertical airflow between dotted lines 221. It will be appreciated that any of a variety of different types of undereave vents 223 can be used. In this configuration, air can flow upward along the sidewall 189, through the undereave vent(s) 223, and then into the building underneath the first roof-cover 152. In other embodiments, the undereave vents 223 are omitted from the design, such that air cannot flow upward along the sidewall 189 and into the building. In some embodiments, air can flow into the region underneath the first roof-cover 152 by flowing through one or more leading edge vents 185 at the eave 182 and between the rafters 124 and the first roof-cover. Each leading edge vent 185 permits airflow between the building exterior and the airspace under the first roof-cover 152. The eave 182 can have one leading edge vent 185 that extends across the entire edge, or alternatively a plurality of shortened leading edge vents 185 separated by air barriers. The leading edge vents 184 and, optionally, 185 can comprise conventional eave vents, preferably with screens for preventing larger matter from entering the airspaces adjacent the roof-covers 152 and 154. In some embodiments, the undereave vents 223 and leading edge vents 185 are both omitted from the design, such that exterior air is simply prevented from flowing into the region underneath the first roof-cover 152. In these embodiments, the leading edge vents 185 can be replaced with a single air barrier extending along the entire eave 182.

Figure 21B:
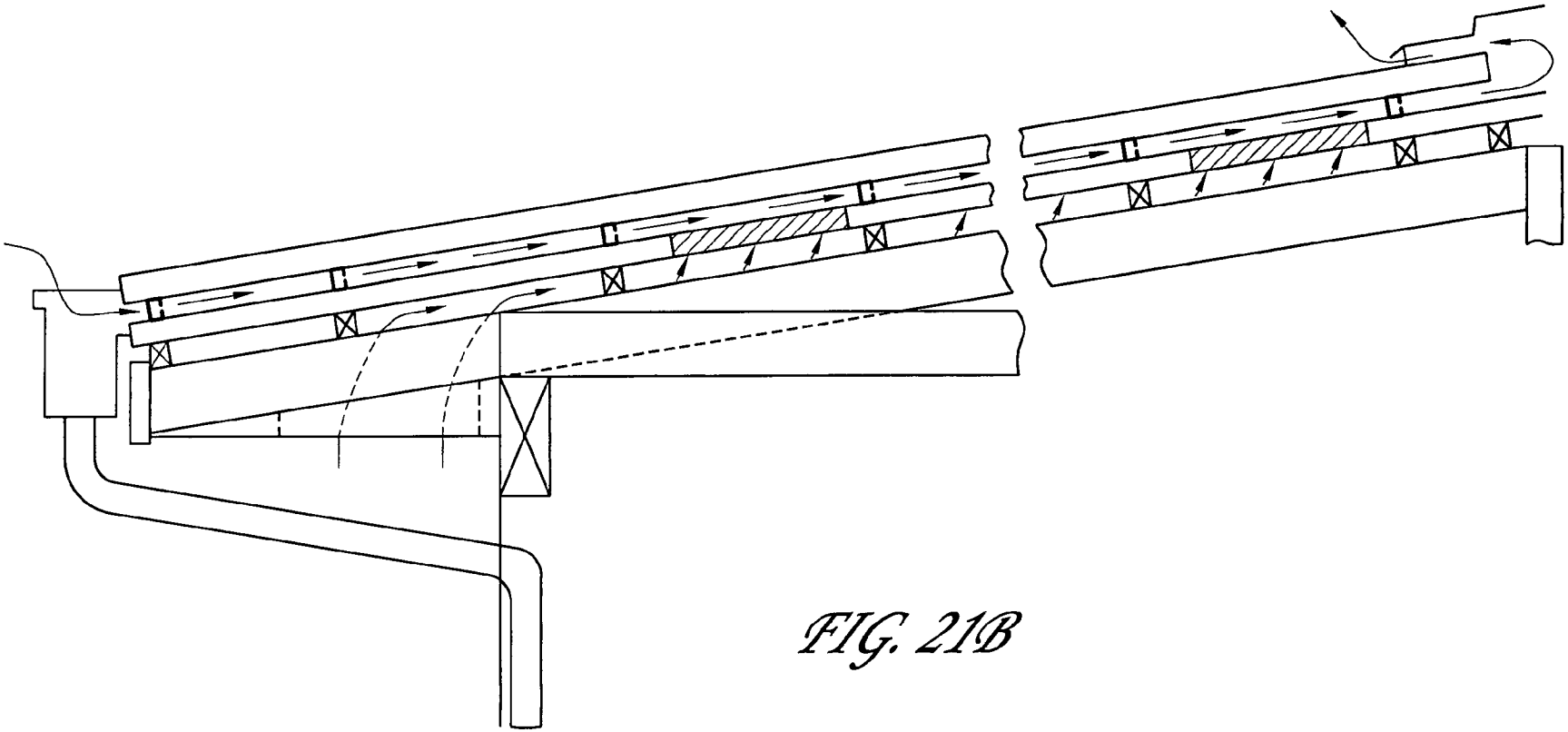
FIG. 21B is the view of FIG. 21A, illustrating airflow through the roof.

FIG. 21B shows the airflow through the system, illustrated by arrows. In use, air outside the building tends to flow through the leading edge vents 184 into the thin airspace 168. The air continues upward through the airspace 168 toward the ridge 22. As the air flows upward through the airspace 168, it is joined by air that flows upward from within the building through the vents 160 of the first roof-cover 152. At the ridge 22, the air escapes the building through the ridgeline vent 151. In particular, the air flows underneath the sides of the elongated canopy 172. It will be appreciated that the leading edge vents 184 (and 185) and undereave vents 223 can be omitted from the design, in which case the thin airspace 168 only provides a flow path for the escape of air from within the building. However, by receiving air from outside the building, the leading edge vents 184 can advantageously increase the upward airflow through the airspace 168, which improves ventilation by sweeping out some of the air underneath the first roof-cover 152. Also, airflow through the air layer 68 minimizes the deleterious effects of trapped moisture (e.g., rotting, mold, condensation, hothouse gases, etc.) Thus, the thin airspace 168 acts as an insulating air layer to reduce conductive heat flow through the roof 150. It also provides a flow path for ventilation, as described above. Another advantage of this dual roof-cover design is that the second roof-cover 154 shields the first roof-cover 152 from direct sunlight, thus reducing the degree to which the roof heats the air in the attic or the space underneath a vaulted ceiling.

In one embodiment, the top surface of the second roof-cover 154 is configured to reflect radiation. This further helps to reduce the roof-heating effect of solar radiation. In one embodiment, the second roof-cover 154 comprises a reflector material, functionally similar to the reflectors that automobile drivers often leave in their vehicles' front windows to reflect sunlight away from the vehicle interior. The reflector material can comprise either the sole layer or one of multiple layers of the second roof-cover 154. For example, the second roof-cover 154 can comprise a reflector material layer secured on top of the layers described above with respect to FIG. 19. Alternatively, the second roof-cover 154 may comprise only a reflector material. It will be appreciated that this aspect of the invention (a reflector material for reflecting solar radiation away from the roof) can be utilized even if there are no vents within the field or ridge of the roof.

In some embodiments, a radiant barrier paint additive is applied onto the building walls to reflect away radiation and further reduce the temperature inside the building. This improves the system because the vents do not have to do as much "work." In other words, the vents keep the temperature down by providing flow paths for the escape of warmer air. By reflecting solar radiation away from the building, the radiant barrier paint additive further reduces the temperature inside the building and thereby enhances the benefits of the ventilation system.

In another embodiment, the top surface of the roof 150 is covered by a material that is configured to absorb solar radiation and direct it into an energy storage element for electrical power (e.g., solar panels). Advantageously, the roof 150 provides ventilation, air-layer insulation, and solar power collection. Conventional solar power collection apparatuses can be used. In this way, the energy savings benefits of the roof 150 are increased because the roof 50 combines a ventilated air layer 68 with solar power collection.

Figure 22:
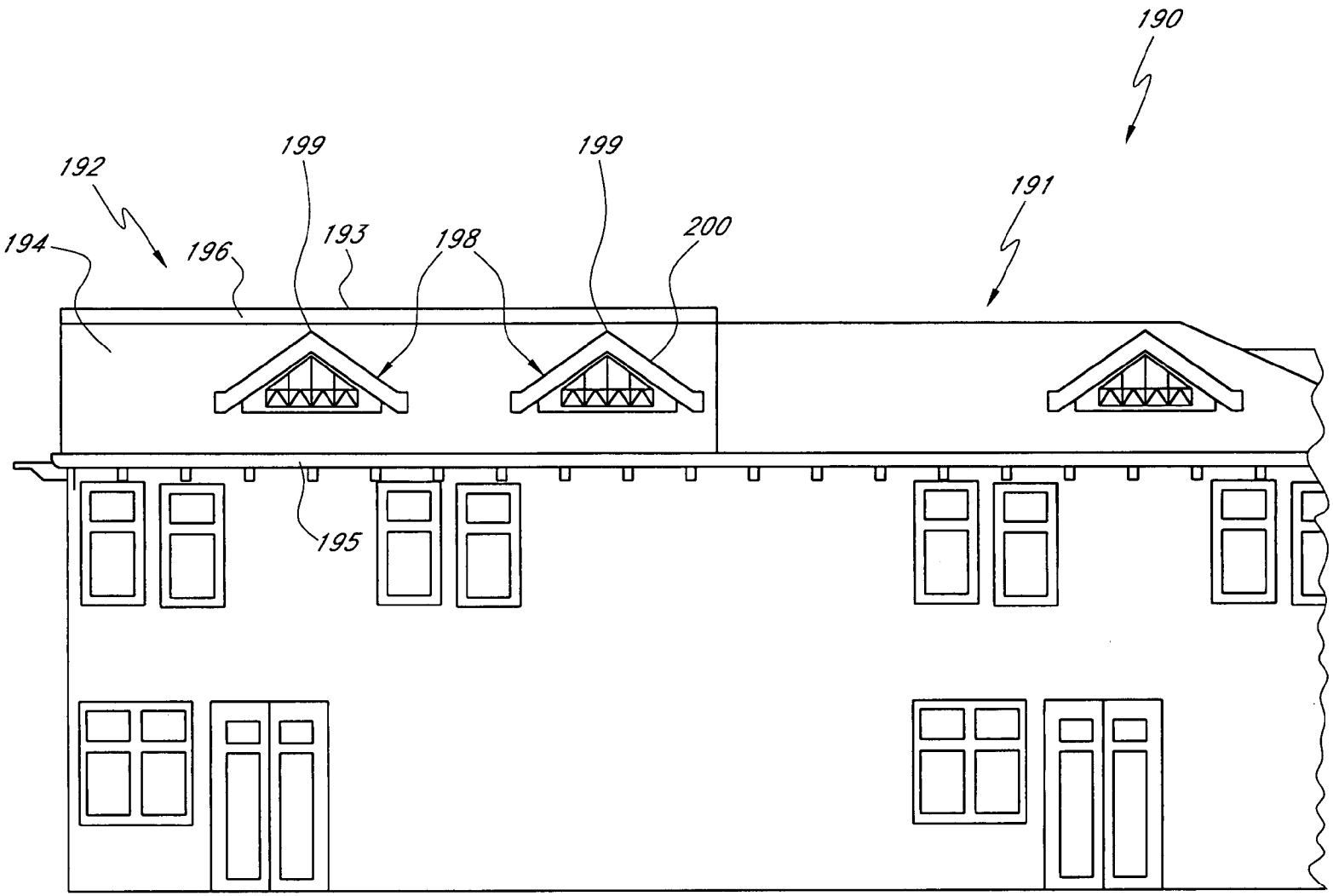
FIG. 22 is a side view of a portion of a building whose roof includes portions according to the design of the roof and ridgeline roof vent of FIGS. 19-21.
Figure 23:
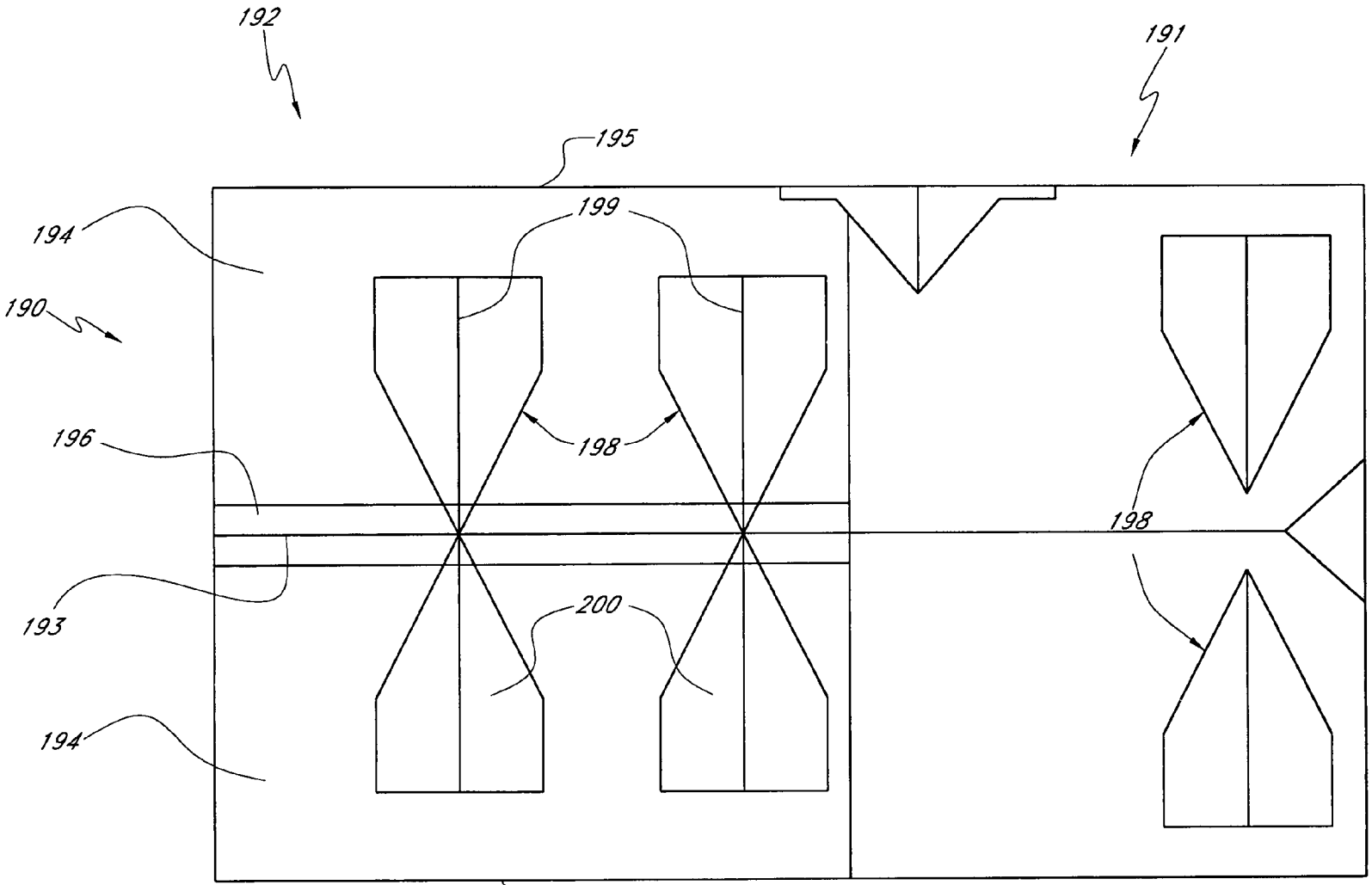
FIG. 23 is a top view of the building portion of FIG. 22.

The dual roof-cover design of FIGS. 19-21 can be employed in a wide variety of roofs. For example, FIGS. 22 and 23 illustrate a building portion 190 having roof sections 191 and 192, each of which includes "dormers" 198. The roof section 191 is a conventional roof, but the roof section 192 is a two-layer roof with a design similar to that of the roof 150 of FIGS. 19-21. The roof section 192 comprises a ridge 193, two sloped roof-portions 194, eaves 195, and a ridgeline vent having a canopy 196. Each dormer 198 of the roof section 192 includes two sloped roof-portions 200. Preferably, each of the sloped roof-portions 194 and 200 includes two roof-covers with a ventilated thin airspace therebetween, such as illustrated and described above with respect to FIGS. 19-21. The eaves 195 preferably include leading edge vents such as the vents 184 and/or 185 described above. The dormers 198 of the roof section 192 preferably include ridgeline vents along the ridges 199. In some cases, it may be desirable to utilize a ventilated roof according to the principles of the present invention over building portions that are used as general living areas (e.g., living rooms, dining rooms, play areas for children, etc.).

In warmer and wetter climates (such as Southeast Asia), the dual roof-cover design shown in FIGS. 19-21 is expected to reduce the temperature of therebelow building portions by as much as 20° F., without the aid of air-conditioning. This roof 150 entails a one-time cost at the building development stage yet provides substantial energy-savings benefits throughout the life of the building and roof. The roof 150 is also expected to be very effective in stopping water leakage through the roof. Water leakage often occurs through vents in the roof. By providing a water-resistant second roof-cover 154 with a canopied ridgeline vent 151 above the first roof-cover 152, the exposure of the vents 160 to water is substantially reduced. The canopied and baffled ridgeline vent 151 substantially prevents the ingress of water onto the roof-cover 152. Even if a little water gets through the ridgeline vent 151, it is likely to harmlessly flow down the first roof-cover 152 and fall into the gutter 186. Preferably, the vents 160 are themselves designed to minimize leakage when directly exposed to falling rain. In a preferred embodiment, the vents 160 are configured so that the water that flows downwardly on the first roof-cover 152 flows around the vents 60 substantially without leaking into the building.

In other embodiments, the roof design of FIG. 19 can be employed in roofs having shapes other than two flat portions joined together at a linear ridge. For example, the roof can comprise a sloped lower roof-cover extending downward from an apex of the lower roof-cover, and a sloped upper roof-cover extending downward as if from an apex of the upper roof-cover. The upper roof-cover is spaced above the lower roof-cover so that a thin gap or airspace is formed therebetween. In such an arrangement, the upper roof-cover can have an upper edge terminating under the apex of the upper roof-cover and circumscribing a substantially vertical line passing through the apices so as to define an opening in the upper roof-cover. A cover or canopy can be provided spaced above the opening. Screens, filters, baffles, and other elements analogous to those shown in FIGS. 19-21 can also be provided, modified as necessary to suit this geometry.

Figure 25:
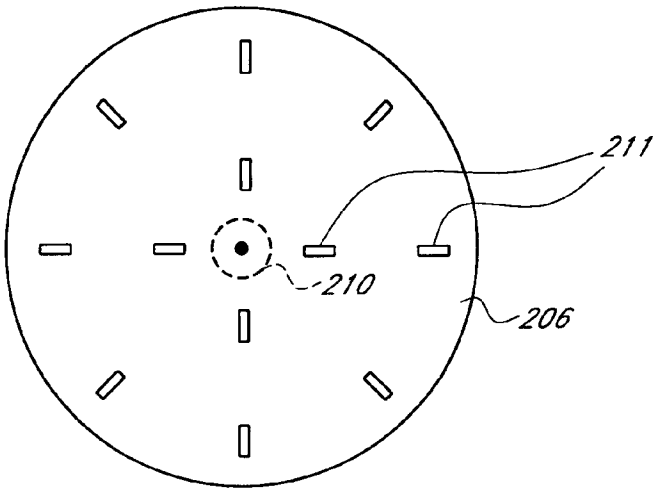
FIG. 25 is a top partially cut-away view of the building of FIG. 24.
Figure 24:
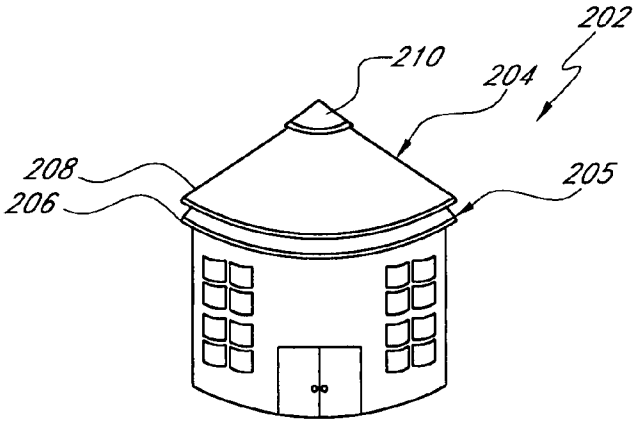
FIG. 24 is a perspective view of a circular building having a roof according to principles of the present invention.

For example, FIG. 24 illustrates a circular building 202 having a roof 204 according to principles of the present invention. In particular, the roof 204 comprises, from bottom-to-top, a first conical roof-cover 206, a second conical roof-cover 208, and a conical canopy 210. These elements are spaced somewhat from one another to facilitate airflows therewithin. Further, these elements are preferably configured together in a manner consistent with the inventive principles of the embodiments of FIGS. 19 and 21A-B. The roof-covers 206 and 208 are preferably spaced apart 3-6 inches by, e.g., circular purlins or sloped rafters. The eave 205 preferably includes one or more screened leading edge vents to permit airflow between the building exterior and the airspace between the roof-covers 206 and 208. The second roof-cover 208 can include reflective material or solar energy collection panels, as described above. The roof-covers 206 and 208 can include insulation layers as described above. FIG. 25 is a top view of the building 202 with the second roof-cover 208 removed to show a pattern of vents 211 in the first roof-cover 206. The density of the vents 211 in the first roof-cover 206 is preferably as described above with respect to the embodiment of FIG. 19. In addition to roofs with completely circular or completely polygonal shapes, it will be appreciated that the dual roof-cover design can be employed on roofs that are partially circular or curved and partially straight-edged.

Figure 28A:
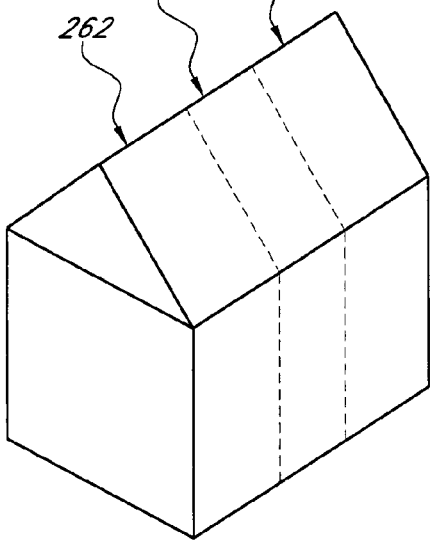
FIG. 28A is a top perspective view of a building according to another embodiment of the present invention.
Figure 28B:
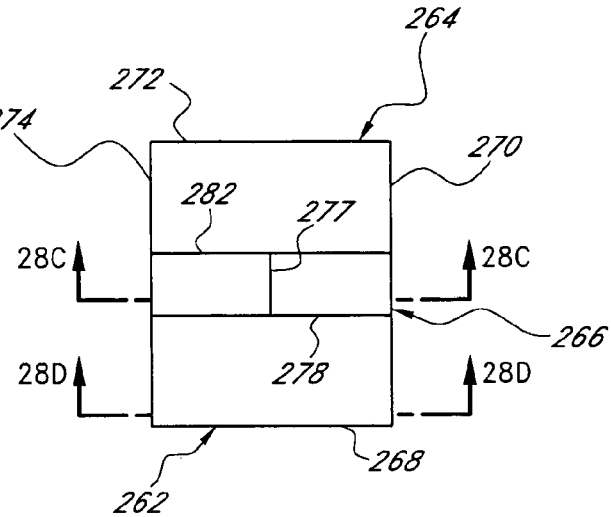
FIG. 28B is a horizontal sectional view of a building according to another embodiment of the present invention, taken along lines 28B-28B of FIG. 28C or 28D.
Figure 28C:
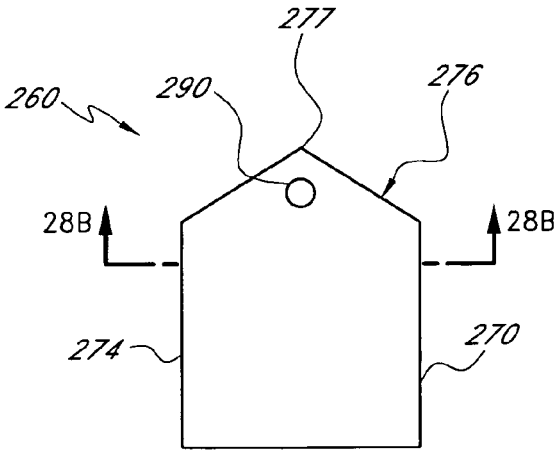
FIG. 28C is a vertical sectional view of the building of FIG. 28B, taken along line 28C-28C of FIG. 28B.
Figure 28D:
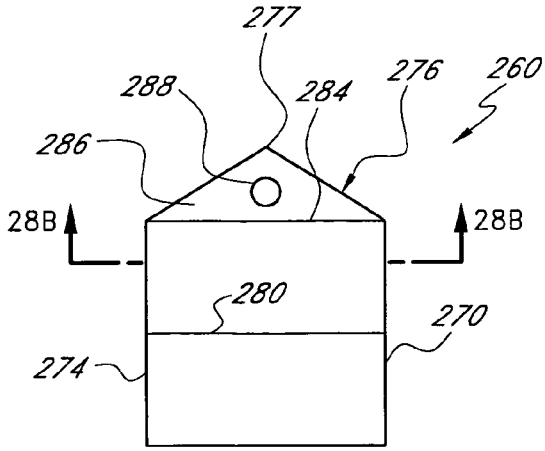
FIG. 28D is a vertical sectional view of the building of FIG. 28B, taken along line 28D-28D of FIG. 28B.

FIGS. 28A-D illustrate a multiple-story building 260 comprising a first multiple-story portion 262, a second multiple-story portion 264, and a central portion 266. In the illustrated embodiment, these portions 262, 264, and 266 are formed inside a rectangular structure defined by generally vertical exterior walls 268, 270, 272, and 274. In the illustrated embodiment, the portions 262 and 264 have attics and the portion 266 has a vaulted ceiling. The building 260 includes a two-sided roof 276 with a generally central ridge 277. The first portion 262 is defined by portions of the exterior walls 268, 270, and 274 and an interior wall 278. As shown in FIG. 28D, the first portion 262 includes one or more generally horizontal structures 280 defining separate stories of the first portion 262. The first portion 262 also includes a ceiling 284 that defines an attic space 286 between the roof 276 and the ceiling 284. Similarly, the second portion 264 is defined by portions of the exterior walls 270, 272, and 274 and an interior wall 282. While not shown in the figures, the second portion 164 also includes one or more generally horizontal structures 280 defining separate stories of the second portion 264, and a ceiling defining an attic space 286 under the roof 276. The central portion 266 does not include any horizontal structures (e.g., 280) or ceiling (e.g., 284) and is preferably continuously open from the ground floor to the bottom surface of the roof 276.

In order to permit airflow into the attic spaces 286, the interior walls 278 and 282 preferably include holes 288 and 290, respectively, above the ceilings 284 and preferably generally aligned vertically with the ridge 277. The hole 288 permits air within the central portion 266 to flow upward and through the wall 278 into the attic space 286 of the first portion 262. Similarly the hole 290 permits air within the central portion 266 to flow upward and through the wall 282 into the attic space 286 of the second portion 262. The roof 276 preferably includes roof vents, such as those described above, for permitting the attic air to flow through the roof to the outside of the building 260. It will be appreciated that the size and shape of the holes 288 and 290 can vary, giving due consideration to the facilitating a desired amount of airflow through the holes. Preferably, the holes 288 and 290 are circular.

The vents, vent arrangements, and roof of the various embodiments of the present invention are preferably employed in a building that does not include any forced ventilation ducts or apparatus. Preferably, the only ventilation apparatus of the building is the passive ventilation apparatus described herein, plus equivalents thereof. The buildings of the invention are preferably configured only for passive ventilation.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications thereof. Thus, it is intended that the scope of the present invention herein disclosed should not be limited by the particular disclosed embodiments described above, but should be determined only by a fair reading of the claims that follow.

What is claimed is:

1. A building comprising:

a substantially air-impervious bottom floor;

a generally vertical exterior wall structure surrounding at least a portion of the bottom floor and defining an outer periphery of the building, the exterior wall structure being substantially air-impervious except for the presence of a plurality of wall-vents in the exterior wall structure, the wall-vents permitting airflow through the exterior wall structure;

one or more generally vertical interior walls within the exterior wall structure, the one or more interior walls defining a plurality of rooms of the building, each of the one or more interior walls acting as a division between two of the rooms, the one or more interior walls being substantially air-impervious except for the presence of one or more wall-vents in the one or more interior walls, each of the one or more wall-vents permitting airflow through one of the one or more interior walls and having a lower edge spaced from a floor of a room containing the wall-vent; and a roof positioned above the bottom floor, the exterior wall structure, and the one or more interior walls, the roof being substantially air-impervious except for the presence of one or more roof-vents in the roof, each of the one or more roof-vents being oriented generally along a planar portion of the roof and permitting airflow between an airspace immediately underneath the roof and within the building and an airspace immediately above the roof.

2. The building of claim 1, wherein each of the one or more roof-vents is substantially entirely contained within the roof.

3. The building of claim 1, wherein the one or more interior walls comprise a plurality of interior walls, each of the interior walls having at least one wall-vent.

4. The building of claim 1, wherein the exterior wall structure comprises a plurality of substantially planar wall portions joined together.

5. The building of claim 4, wherein each of the planar wall portions includes at least one wall-vent.

6. The building of claim 1, wherein at least one of the wall-vents in the exterior wall structure includes a filter configured to prevent matter other than air from entering the building through the at least one of the wall-vents.

7. The building of claim 6, wherein the filter is configured to prevent water, vermin, insects, dust, plants, and leaves from entering the building through the at least one of the wall-vents.

8. The building of claim 1, further comprising one or more floor-vents in the bottom floor, each floor-vent permitting generally vertical airflow through the bottom floor.

9. The building of claim 8, wherein the one or more floor-vents are oriented generally along a planar portion of the bottom floor.

10. The building of claim 9, wherein the one or more floor-vents are substantially entirely contained within the bottom floor.

11. The building of claim 8, wherein the bottom floor and exterior wall structure are elevated above a ground level such that air outside of the outer periphery of the building can flow underneath the bottom floor.

12. The building of claim 11, wherein at least one of the one or more underfloor-vents includes a filter configured to prevent matter other than air from entering the enclosed airspace below the bottom floor through the at least one of the one or more underfloor-vents.

13. The building of claim 12, wherein the filter is configured to prevent water, vermin, insects, dust, plants, and leaves from entering the enclosed airspace from entering the enclosed airspace below the bottom floor through the at least one of the one or more underfloor-vents.

14. The building of claim 8, wherein the exterior wall structure extends below the bottom floor to define a peripherally enclosed airspace below the bottom floor, the building further comprising one or more underfloor-vents configured to permit airflow between the exterior of the building and the enclosed airspace below the bottom floor.

15. The building of claim 1, wherein at least one of the one or more roof-vents includes a filter configured to prevent matter other than air from entering the building through the at least one of the one or more roof-vents.

16. The building of claim 15, wherein the filter is configured to prevent water, vermin, insects, dust, plants, and leaves from entering the building through the at least one of the one or more roof-vents.

17. The building of claim 1, wherein at least one of the one or more roof-vents is translucent.

18. The building of claim 1, wherein the roof includes tiles and at least one of the one or more roof-vents has an appearance that is similar to the tiles.

19. The building of claim 1, further comprising a generally horizontal ceiling positioned below the roof so that the ceiling and the roof define an attic airspace therebetween, the ceiling being substantially air-impervious except for the presence of one or more ceiling-vents in the ceiling, each of the one or more ceiling-vents being oriented generally along a planar portion of the ceiling and permitting airflow between the attic airspace and an airspace immediately below the ceiling.

20. The building of claim 19, wherein each of the one or more ceiling-vents is substantially entirely contained within the ceiling.

21. The building of claim 1, further comprising one or more generally horizontal structures elevated above the bottom floor and dividing the building into multiple stories, each of the one or more horizontal structures defining one or more floors of one or more rooms immediately above the horizontal structure and one or more ceilings of one or more rooms immediately below the horizontal structure, wherein each of the one or more horizontal structures is substantially air-impervious except for the presence of at least one ceiling-floor vent therein, the at least one ceiling-floor vent of each horizontal structure being oriented generally along a planar portion of the horizontal structure and permitting generally vertical airflow through the horizontal structure.

22. The building of claim 21, wherein the at least one ceiling-floor vent of each horizontal structure is substantially entirely contained within the horizontal structure.

23. A building comprising:

a bottom floor that is substantially air-impervious except for the presence of one or more floor-vents therein, each of the one or more floor-vents permitting airflow between an airspace immediately above the bottom floor and an airspace immediately below the bottom floor;

a generally vertical exterior wall structure surrounding at least a portion of the bottom floor and defining an outer periphery of the building, the exterior wall structure being substantially air-impervious except for the presence of a plurality of wall-vents in the exterior wall structure, the wall-vents permitting airflow through the exterior wall structure;

one or more generally vertical interior walls within the exterior wall structure, the one or more interior walls defining a plurality of rooms of the building, each of the one or more interior walls acting as a division between two of the rooms, the one or more interior walls being substantially air-impervious except for the presence of one or more wall-vents in the one or more interior walls, each of the one or more wall-vents permitting airflow through one of the one or more interior walls and having a lower edge spaced from a floor of a room containing the wall-vent;

a roof positioned above the bottom floor and the exterior wall structure, the roof being substantially air-impervious except for the presence of one or more roof-vents therein, each of the one or more roof-vents being oriented generally along a planar portion of the roof and permitting airflow between an airspace immediately underneath the roof and within the building and an airspace immediately above the roof; and a ceiling positioned below the roof so that the ceiling and the roof define an attic space therebetween, the ceiling being substantially air-impervious except for the presence of one or more ceiling-vents in the ceiling, each of the one or more ceiling-vents being oriented generally along a planar portion of the ceiling and permitting airflow between the attic airspace and an airspace immediately below the ceiling.

24. The building of claim 23, wherein each of the one or more roof-vents is substantially entirely contained within the roof.

25. The building of claim 23, wherein each of the one or more ceiling-vents is substantially entirely contained within the ceiling.

26. The building of claim 23, wherein the bottom floor and exterior wall structure are elevated above a ground level such that air outside of the outer periphery of the building can flow underneath the bottom floor.

27. The building of claim 23, wherein the exterior wall structure extends below the bottom floor to define a peripherally enclosed airspace below the bottom floor, the building further comprising one or more underfloor-vents configured to permit airflow between the exterior of the building and the enclosed airspace below the bottom floor.

28. The building of claim 27, wherein the one or more underfloor-vents comprise one or more wall-vents in portions of the exterior wall structure that extend below the bottom floor.

29. The building of claim 23, wherein each of the one or more floor-vents is oriented generally along a planar portion of the bottom floor.

30. The building of claim 29, wherein each of the one or more floor-vents is substantially entirely contained within the bottom floor.

31. A multiple story building comprising:

a substantially air-impervious bottom floor;

a generally vertical exterior wall structure surrounding at least a portion of the bottom floor and defining an outer periphery of the building, the exterior wall structure being substantially air-impervious except for the presence of a plurality of wall-vents therein, the wall-vents permitting airflow through the exterior wall structure;

one or more generally vertical interior walls within the exterior wall structure, the one or more interior walls defining a plurality of rooms of the building, each of the one or more interior walls acting as a division between two of the rooms, the one or more interior walls being substantially air-impervious except for the presence of one or more wall-vents in the one or more interior walls, each of the one or more wall-vents permitting airflow through one of the one or more interior walls and having a lower edge spaced from a floor of a room containing the wall-vent;

one or more generally horizontal structures elevated above the bottom floor and dividing the building into multiple stories, each of the one or more horizontal structures defining a floor of at least one room immediately above the horizontal structure and a ceiling of at least one room immediately below the horizontal structure, each of the one or more horizontal structures being substantially air-impervious except for the presence of at least one ceiling-floor vent therein, the at least one ceiling-floor vent of each horizontal structure being oriented generally along a planar portion of the horizontal structure and permitting generally vertical airflow through the horizontal structure; and a roof positioned above the bottom floor, the exterior wall structure, the one or more interior walls, and the one or more horizontal structures.

32. The multiple story building of claim 31, wherein the at least one ceiling-floor vent of each horizontal structure is substantially entirely contained within that horizontal structure.

33. The multiple story building of claim 31, wherein the roof is substantially air-impervious except for the presence of one or more roof-vents in the roof, each of the one or more roof-vents being oriented generally along a planar portion of the roof and permitting airflow between an airspace immediately underneath the roof and within the building and an airspace immediately above the roof.

34. A building comprising:

a generally vertical exterior wall structure defining an outer periphery of the building, the exterior wall structure being substantially air-impervious except for the presence of a plurality of wall-vents in the exterior wall structure, the wall-vents permitting airflow through the exterior wall structure; and a room within the exterior wall structure, the room being defined by a plurality of dividing structures that are substantially air-impervious, the room having a plurality of corners;

wherein dividing-structure vents are provided in the dividing structures, wherein at least half of the corners of the room are within 36 inches of at least one of the dividing-structure vents.

35. The building of claim 34, wherein each of the dividing-structure vents is substantially entirely contained within said one of the dividing structures.

36. The building of claim 34, wherein each of the corners of the room are within 36 inches of at least one of the dividing-structure vents.

37. The building of claim 34, wherein the building comprises a plurality of rooms within the exterior wall structure, each of the rooms being defined by a plurality of dividing structures that are substantially air-impervious, each of the rooms having a plurality of corners, and wherein at least half of the corners of a majority of the rooms are within 36 inches of at least one of the dividing-structure vents.

38. The building of claim 37, wherein each of the corners of a majority of the rooms is within 36 inches of at least one of the dividing-structure vents.

39. The building of claim 37, wherein each of the corners of each of the rooms is within 36 inches of at least one of the dividing-structure vents.

40. The building of claim 34, wherein at least half of the corners of the room are within 12 inches of at least one of the dividing-structure vents.

41. The building of claim 34, wherein at least half of the corners of the room are within 6 inches of at least one of the dividing-structure vents.

42. The building of claim 34, wherein said one of the dividing structures comprises a generally vertical interior wall of the building, said dividing-structure vents comprising wall-vents.

43. The building of claim 34, wherein said one of the dividing structures comprises a floor, said dividing-structure vents comprising floor-vents.

44. The building of claim 34, wherein said one of the dividing structures comprises a ceiling, said dividing-structure vents comprising ceiling-vents.

45. The building of claim 34, wherein said one of the dividing structures comprises a horizontal structure defining a ceiling of a lower room and a floor of an upper room, said dividing-structure vents comprising ceiling-floor vents.

46. The building of claim 34, wherein said one of the dividing structures comprises a wall of the exterior wall structure, said dividing-structure vents comprising wall-vents.

47. A building comprising:

a bottom floor;

a generally vertical exterior wall structure surrounding at least a portion of the bottom floor and defining an outer periphery of the building, the exterior wall structure being substantially air-impervious except for the presence of a plurality of wall-vents in the exterior wall structure, the wall-vents permitting airflow through the exterior wall structure; and a roof positioned above the bottom floor and the exterior wall structure, the roof comprising at least two generally flat roof-portions joined together at a ridge, each of the roof-portions having a plurality of corners, each of the roof-portions being substantially air-impervious except for the presence of roof-vents oriented generally along a planar portion of that roof-portion and positioned within 36 inches of at least half of the corners of that roof-portion, each of the roof-vents permitting airflow generally vertically from an interior of the building through the roof.

48. The building of claim 47, wherein each of the roof-vents is substantially entirely contained within the roof-portion of that roof-vent.

49. The building of claim 47, wherein each of the roof-portions includes roof-vents within 36 inches of each of the corners thereof, each of the roof-vents being oriented generally along a planar portion of the roof-portion of that roof-vent and permitting airflow generally vertically through that roof-portion.

50. A building comprising:

an exterior wall structure defining a periphery of the building;

bottom floor within the exterior wall structure;

a roof above the exterior wall structure, the roof comprising at least two generally flat portions joined together at a ridge, each generally flat portion of the roof including one or more roof-vents; and one or more horizontal dividing structures within the exterior wall structure;

wherein dividing-structure vents are provided in each of the one or more horizontal dividing structures, some of the dividing-structure vents being substantially vertically aligned with some of the roof-vents to facilitate substantially vertical airflow through the aligned vents.

51. The building of claim 50, wherein at least one of the horizontal dividing structures is a ceiling.

52. The building of claim 50, wherein at least one of the horizontal dividing structures defines multiple stories of the building.

* * * * *